US011805967B2

(12) United States Patent
Kwon et al.

(10) Patent No.: US 11,805,967 B2
(45) Date of Patent: Nov. 7, 2023

(54) VACUUM CLEANER CONTROL METHOD

(71) Applicant: LG ELECTRONICS INC., Seoul (KR)

(72) Inventors: Sunku Kwon, Seoul (KR); Sehwa Choe, Seoul (KR); Donghyun Lim, Seoul (KR); Chaseung Jun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/627,917

(22) PCT Filed: Jun. 18, 2020

(86) PCT No.: PCT/KR2020/007873
§ 371 (c)(1),
(2) Date: Jan. 18, 2022

(87) PCT Pub. No.: WO2021/015420
PCT Pub. Date: Jan. 28, 2021

(65) Prior Publication Data

US 2022/0361726 A1 Nov. 17, 2022

(30) Foreign Application Priority Data

Jul. 19, 2019 (KR) ..... 10-2019-0087605

(51) Int. Cl.
*A47L 9/28* (2006.01)
*A47L 9/04* (2006.01)
(Continued)

(52) U.S. Cl.
CPC ..... *A47L 9/2831* (2013.01); *A47L 5/30* (2013.01); *A47L 5/362* (2013.01); *A47L 9/0411* (2013.01);
(Continued)

(58) Field of Classification Search
None
See application file for complete search history.

(56) References Cited

U.S. PATENT DOCUMENTS

2003/0217431 A1 11/2003 Uratani et al.

FOREIGN PATENT DOCUMENTS

EP 2505112 A1 * 10/2012 ..... A47L 9/02
EP 3007604 4/2016
(Continued)

OTHER PUBLICATIONS

English Machine Translation for EP-2505112-A1.*
(Continued)

*Primary Examiner* — Natasha N Campbell
*Assistant Examiner* — Pradhuman Parihar
(74) *Attorney, Agent, or Firm* — KED & Associates LLP

(57) ABSTRACT

The present disclosure provides a control method capable of, by using a current value of a nozzle, determining whether a nozzle is separated from a vacuum cleaner and whether the nozzle is reconnected to the vacuum cleaner after separation. To this end, a vacuum cleaner may comprise a nozzle connectable to a suction unit for suctioning dusts. The nozzle may comprise a rotary cleaning unit for applying pressure to a cleaning target surface so as to separate a foreign substance therefrom, and a nozzle motor for driving the rotary cleaning unit. In order to drive the nozzle, a voltage having been controlled by a pulse width modulation (PWM) method is applied, and a measurement unit included in the vacuum cleaner may measure a current value of the nozzle, the current value depending on the applied voltage.

13 Claims, 10 Drawing Sheets

(51) Int. Cl.
*A47L 5/30* (2006.01)
*A47L 5/36* (2006.01)

(52) U.S. Cl.
CPC ..... *A47L 9/2842* (2013.01); *A47L 9/2847* (2013.01); *A47L 9/0477* (2013.01)

(56) References Cited

FOREIGN PATENT DOCUMENTS

| | | | |
|---|---|---|---|
| JP | 2006-051187 | | 2/2006 |
| JP | 2008-264424 | | 11/2008 |
| JP | 2009-017909 | | 1/2009 |
| JP | 2011050505 A | * | 3/2011 |
| JP | 2013-223565 | | 10/2013 |
| KR | 10-0161987 | | 12/1998 |
| KR | 10-1890212 | | 8/2018 |
| KR | 10-2487213 | | 1/2023 |
| WO | WO 2014/199137 | | 12/2014 |

OTHER PUBLICATIONS

English Machine Translation for JP-2011050505-A.*
Korean Office Action dated Nov. 20, 2020 issued in Application No. 10-2019-0087605 (English translation attached).
Korean Notice of Allowance dated May 10, 2021 issued in Application No. 10-2019-0087605 (English translation attached).
International Search Report (with English Translation) and Written Opinion dated Dec. 1, 2020 issued in Application No. PCT/KR2020/007873.
Australian Office Action dated Mar. 30, 2022 issued in Application No. 2020316202.
Extended European Search Report dated Jun. 30, 2023 issued in Application No. 20844588.2.
Korean Office Action dated Aug. 11, 2023 issued in Application No. 10-2022-0182620.

* cited by examiner

【FIG. 1A】
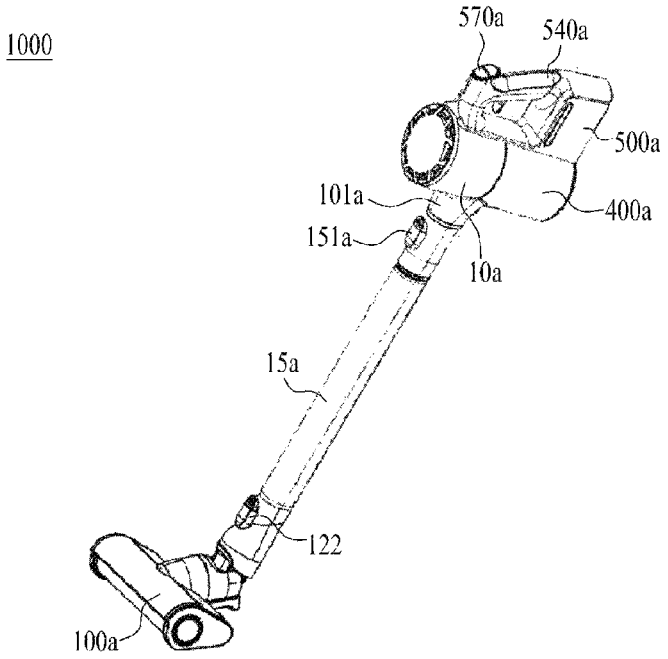
【FIG. 1B】
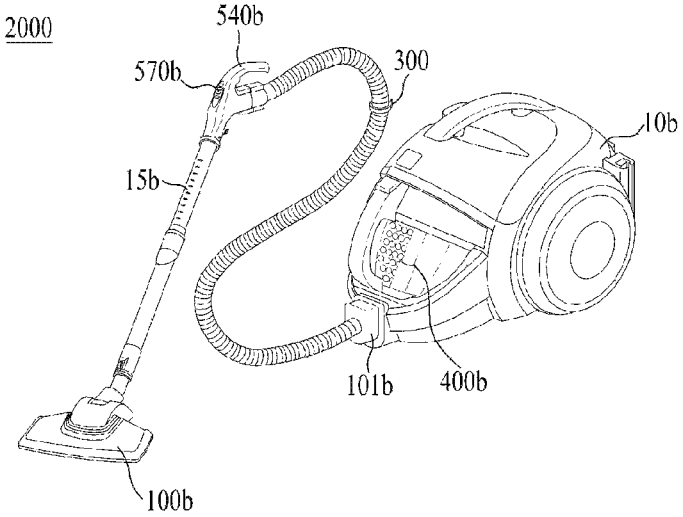

【FIG. 2】
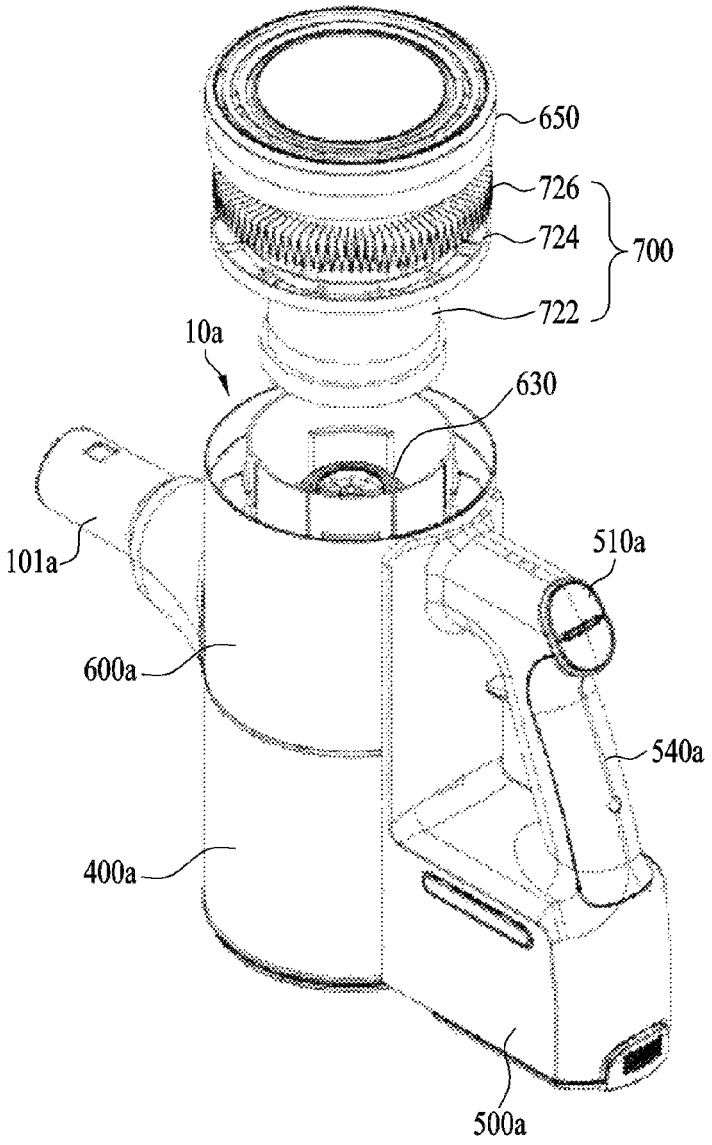

【FIG. 3A】
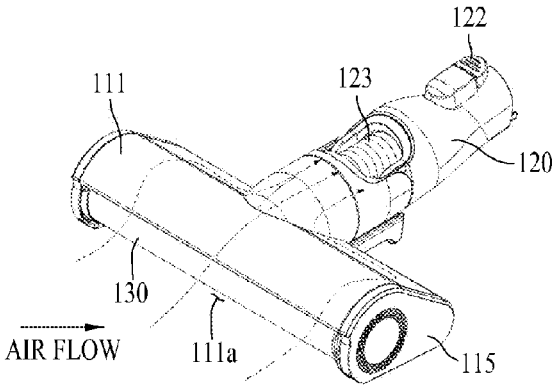
【FIG. 3B】
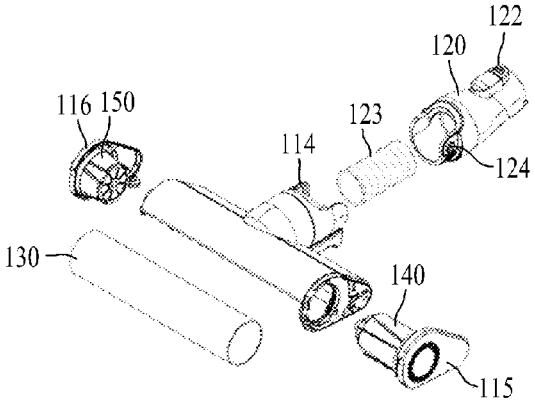
【FIG. 3C】
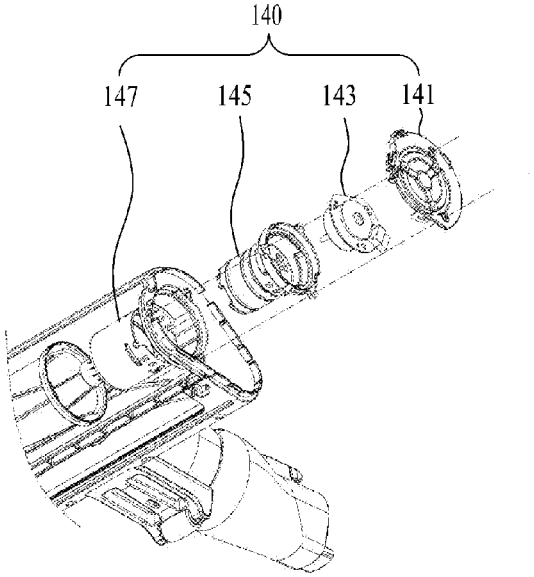

【FIG. 4A】
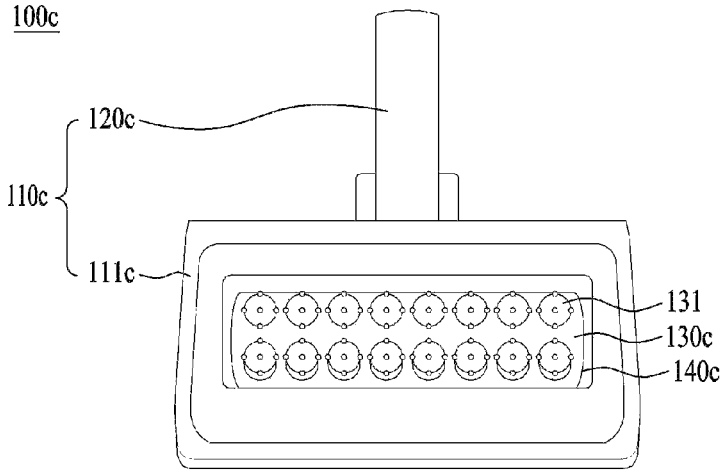
【FIG. 4B】
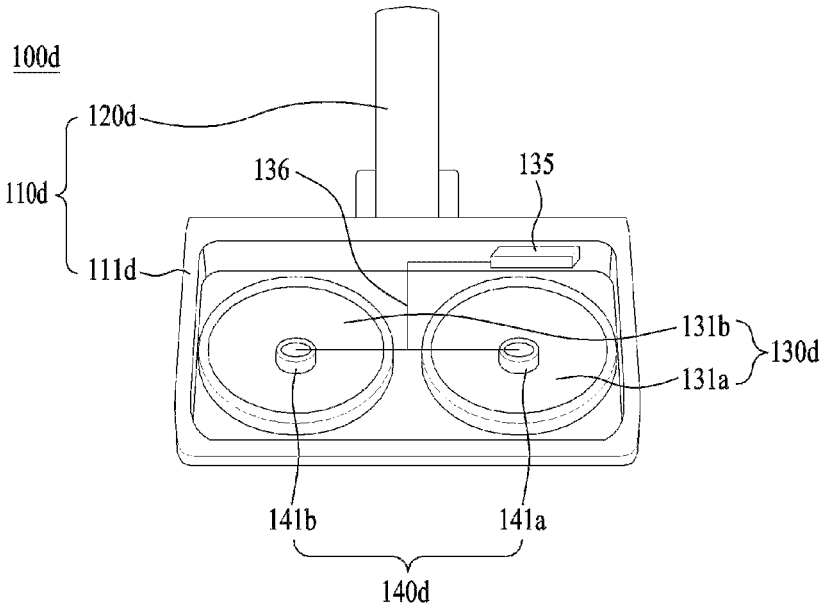

【FIG. 5】
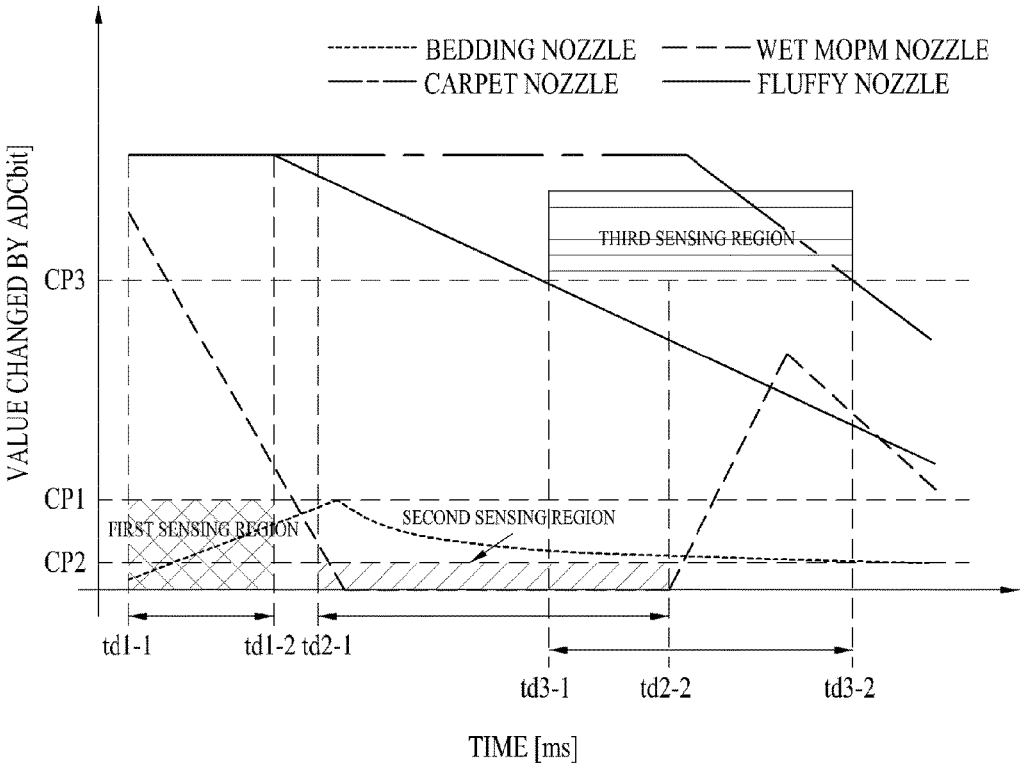

【FIG. 6】
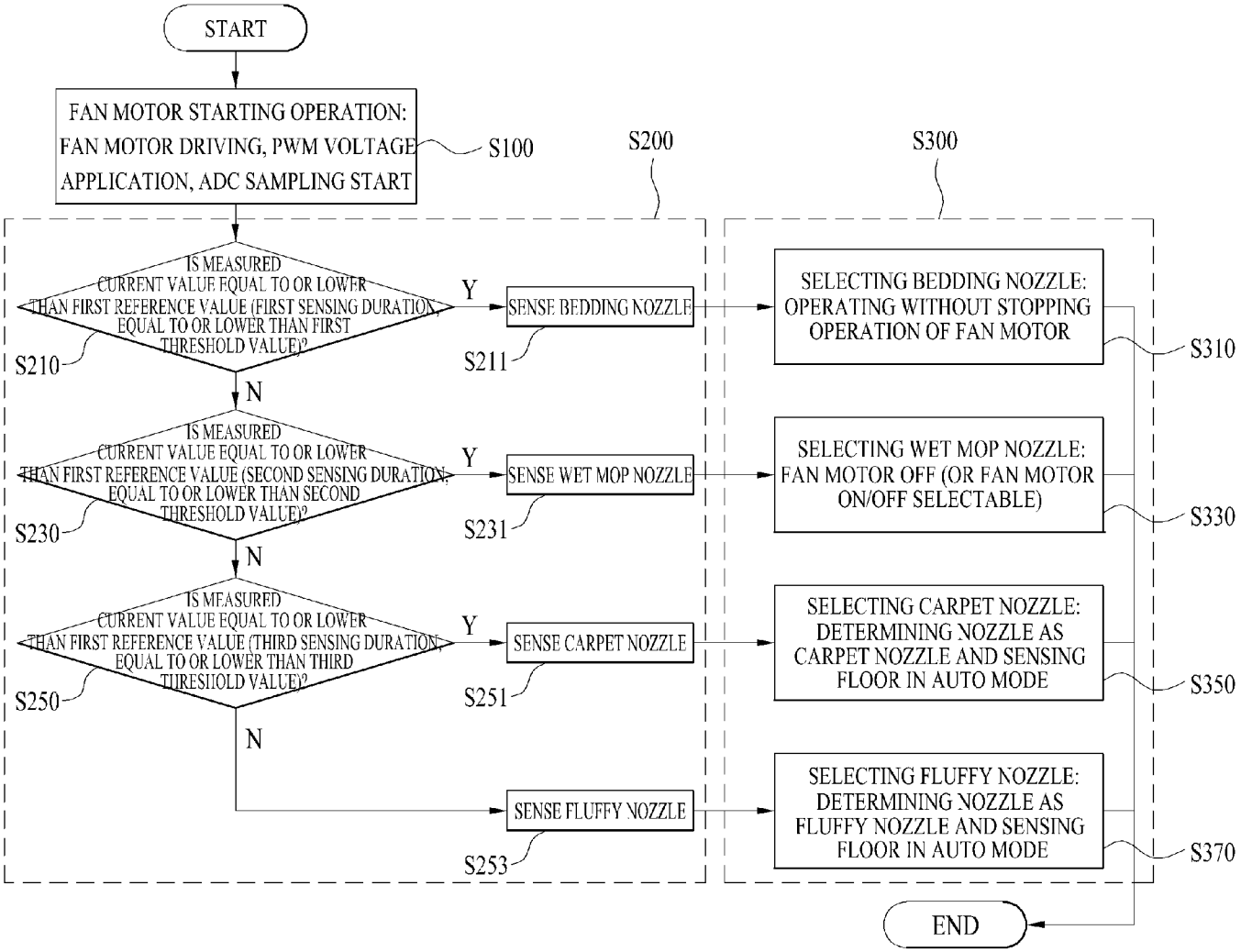

【FIG. 7A】
【FIG. 7B】
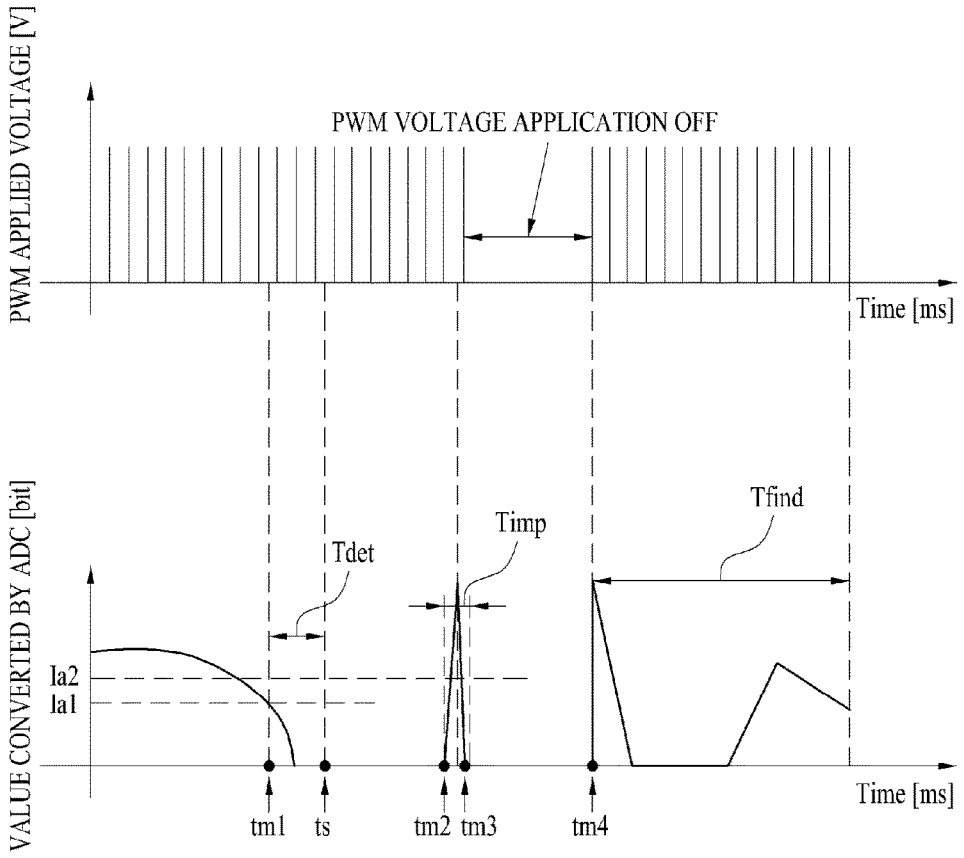

【FIG. 8】
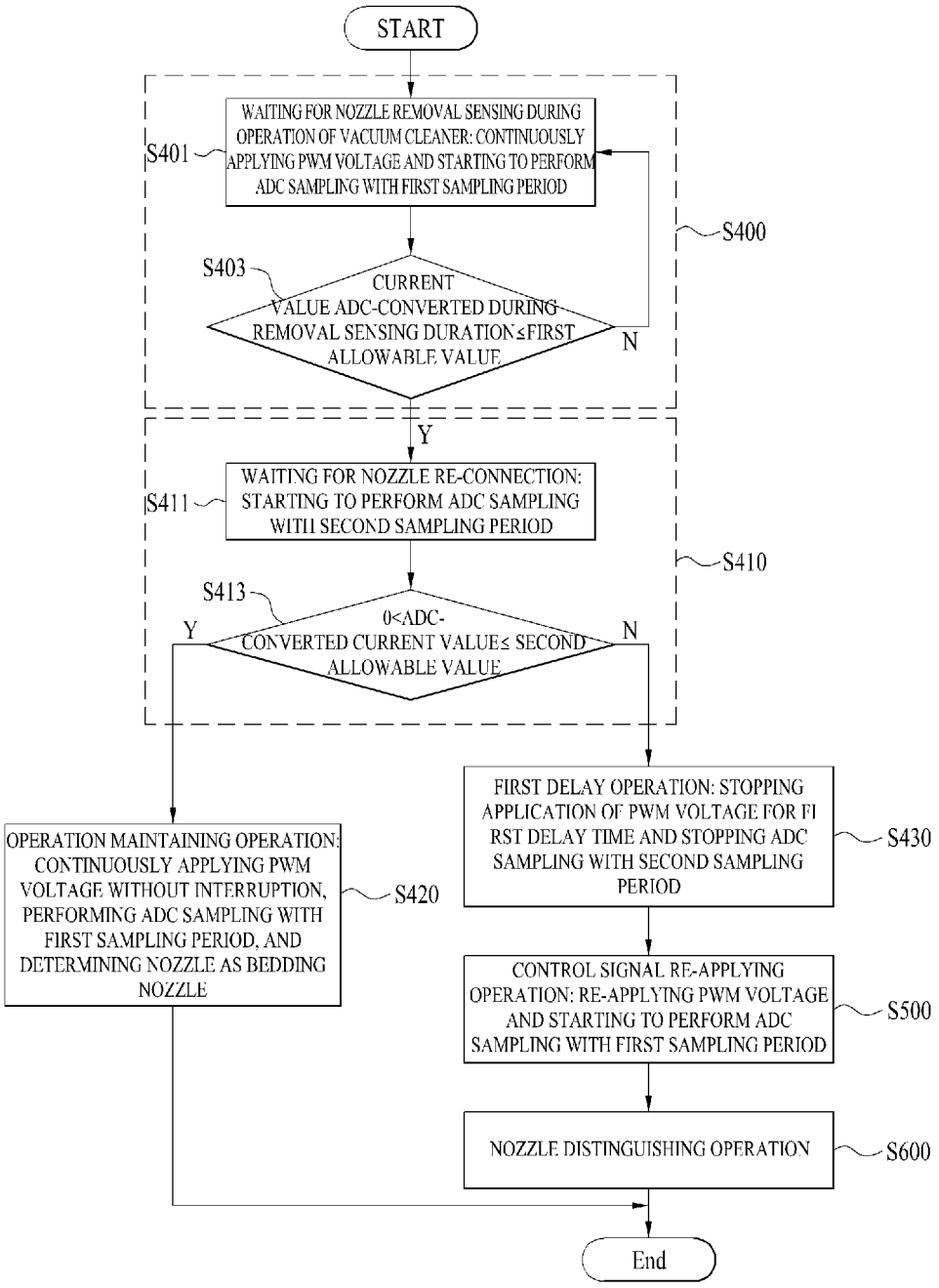

【FIG. 9】
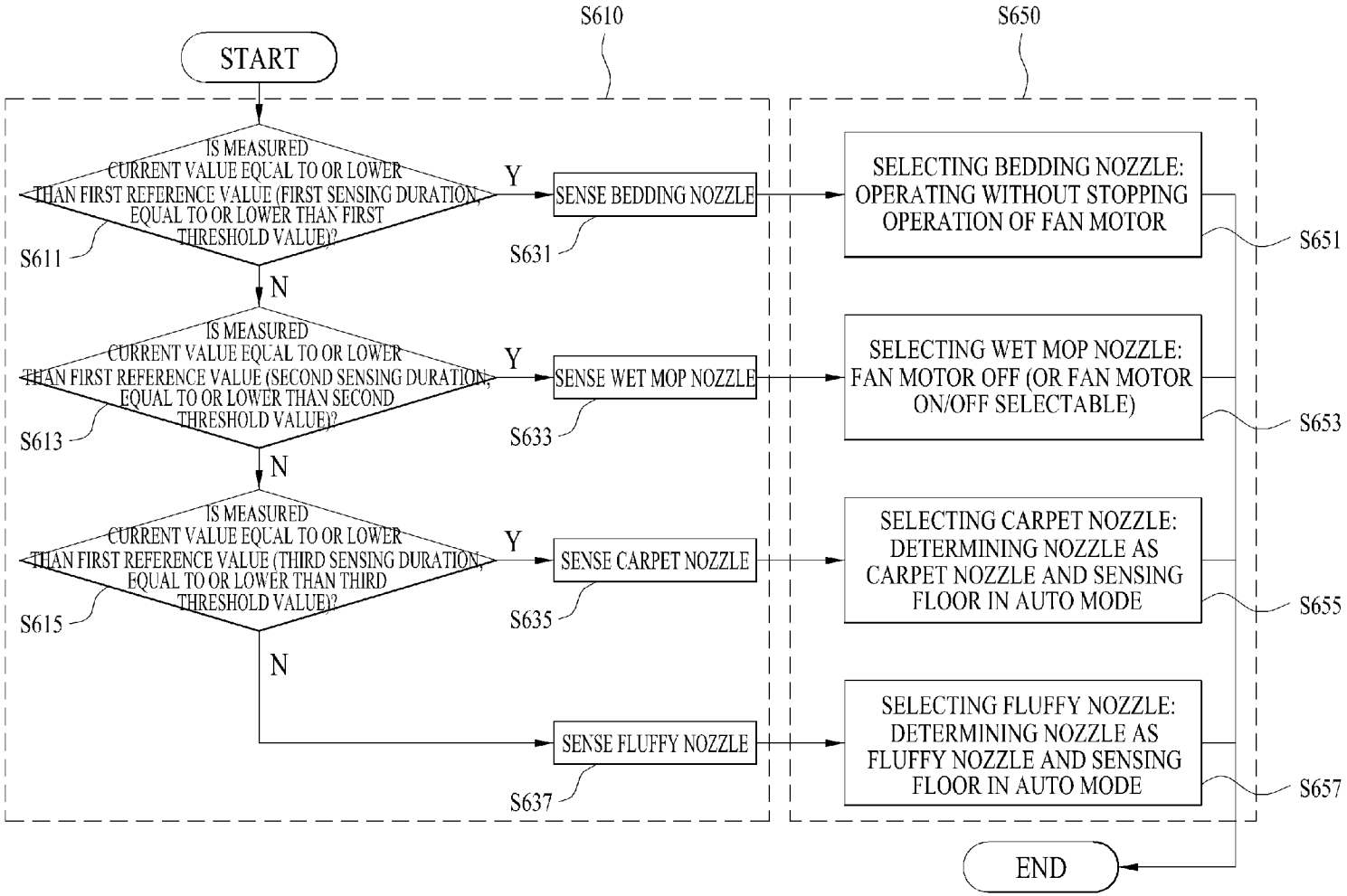

【FIG. 10】
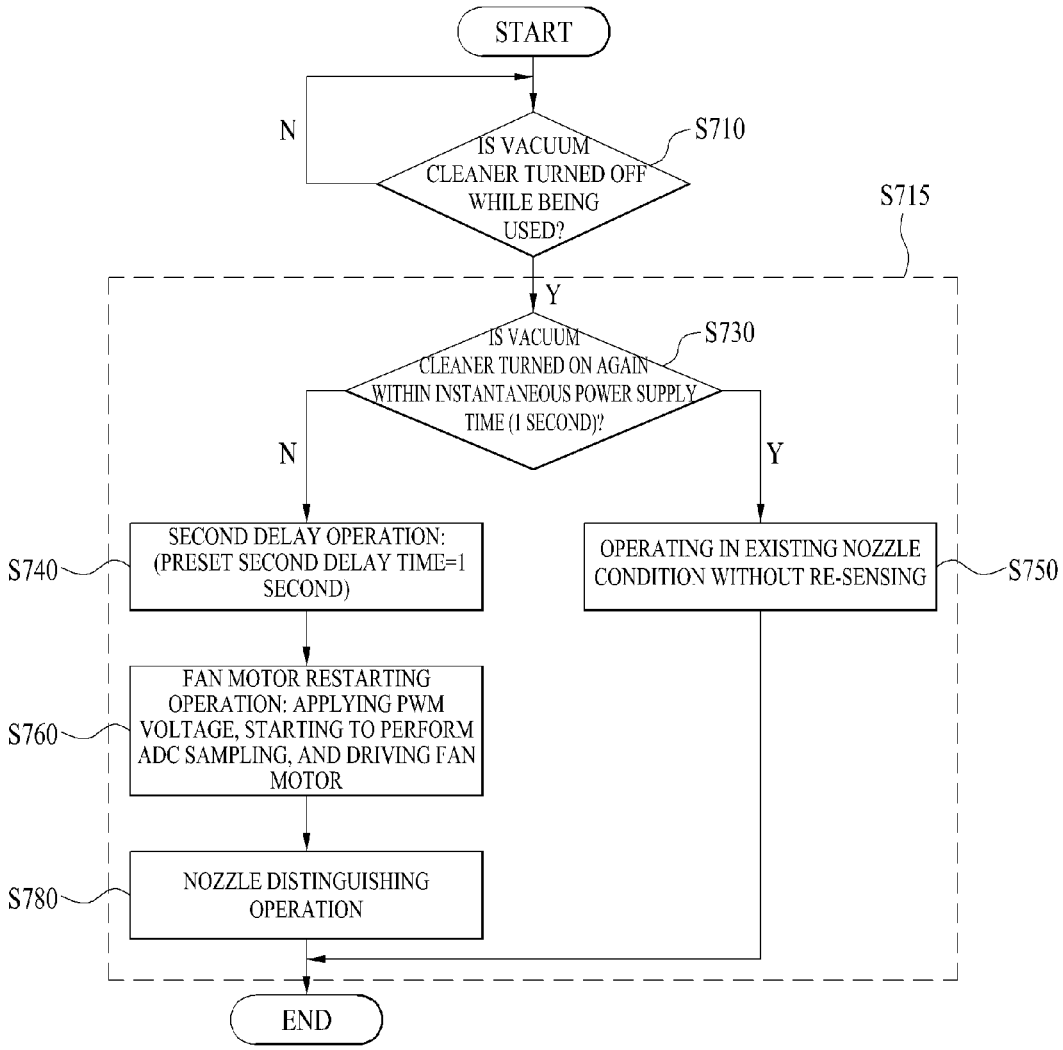

VACUUM CLEANER CONTROL METHOD

CROSS-REFERENCE TO RELATED PATENT APPLICATIONS

This application is a U.S. National Stage Application under 35 U.S.C. § 371 of PCT Application No. PCT/KR2020/007873, filed Jun. 18, 2020, which claims priority to Korean Patent Application No. 10-2019-0087605, filed Jul. 19, 2019, whose entire disclosures are hereby incorporated by reference.

TECHNICAL FIELD

The present disclosure relates to a method for controlling a vacuum cleaner.

BACKGROUND ART

In line with a recent technological development of a vacuum cleaner and a market demand, various nozzles that may be used to be suitable for various situations are being developed.

The various nozzles may be used by selecting an appropriate nozzle based on an object to be cleaned and connecting the selected nozzle to the vacuum cleaner. Such nozzles not only simply have various shapes, but also have a rotary cleaning portion referred to as an agitator for easily separating, from a surface-to-be-cleaned or a cleaning-target-surface, and sucking foreign substances by being rotatably coupled to the nozzle, and a nozzle motor for driving the rotary cleaning portion, separately from a fan motor. The rotary cleaning portion pressurizes or scrapes the surface-to-be-cleaned to allow dusts or the foreign substances to be separated from the surface-to-be-cleaned and to be sucked into the vacuum cleaner through a suction force of the fan motor.

The nozzles including such a rotary cleaning portion may be divided into, depending on the surface-to-be-cleaned, a bedding nozzle for cleaning bedding, a carpet nozzle for cleaning a carpet, a wet mop nozzle for cleaning with water, a fluffy nozzle for general use, and the like. Accordingly, a user may select the appropriate nozzle and use the nozzle after installing the nozzle on the vacuum cleaner.

In order to control such various nozzles, it is necessary to apply an appropriate rated voltage and to adjust revolutions per minute of the fan motor based on the surface-to-be-cleaned. To this end, a control method that senses a purpose of the nozzle to be used is firstly required. In addition, for convenience of the user, there is a need for a control method that automatically senses which nozzle the current nozzle is without the user needing to recognize the same is required.

For example, the nozzles may be distinguished as the nozzles use different types of motors, for example, a brushless DC (BLDC) motor or a DC motor. This is because current characteristics are different because whether to apply a capacitor for voltage smoothing is different based on the type of motor. Therefore, the type of nozzle may be easily sensed by analyzing such current characteristics.

When a nozzle using the BLDC motor is sensed, a constant voltage may be applied without applying a voltage controlled in a pulse width modulation duty (PWM duty) scheme. In a case of the DC motor, the voltage controlled in the pulse width modulation (PWM) scheme or a constant voltage of a varied magnitude may be applied.

However, this is only possible when the motors of the different types are used. For example, when motors of the same type are used, there is a problem in that it is difficult to distinguish two or more motors with such analysis method. In order to distinguish them, there is a problem that separate sensing means such as a current transducer is required. In addition, there is a problem in that distinguishment from another motor is impossible because of a large deviation of a current value measured during the current characteristic analysis.

In addition, even when the nozzle is distinguished when the vacuum cleaner starts driving, when the nozzle is replaced while using the vacuum cleaner, there is a problem that the newly connected nozzle is not able to be distinguished. For example, when the user replaces the nozzle in use with another nozzle without turning off the vacuum cleaner during use, the vacuum cleaner operates the newly connected nozzle in the same manner as an operation scheme of the nozzle used before the removal.

DISCLOSURE

Technical Problem

The present disclosure aims to provide a control method that may sense whether a nozzle connected to a vacuum cleaner has been separated (or removed) during use of the vacuum cleaner. In addition, the present disclosure aims to provide a control method that may sense whether a nozzle, including a removed nozzle, is connected to a vacuum cleaner. In addition, the present disclosure aims to provide a control method that may identify what type of nozzle a nozzle re-connected after removal is. That is, the present disclosure aims to provide a control method that may automatically sense a type of nozzle when mounting two or more different types of nozzles using the same type of motor to a vacuum cleaner main body. In addition, the present disclosure aims to provide a control method that may distinguish a type of nozzle without separate sensing means. In addition, the present disclosure aims to provide a method for reducing a deviation of a measured current value.

Technical Solutions

The present disclosure is to provide a control method for determining whether a nozzle is sensed or mounted by analyzing a current profile of the nozzle connected to a vacuum cleaner to sense whether the nozzle connected to the vacuum cleaner has been removed during use of the vacuum cleaner or to sense whether the nozzle has been re-connected.

When one of several nozzles is connected to the vacuum cleaner and used, a voltage controlled in the same fixed pulse width modulation (PWM) scheme or a constant voltage is applied to a nozzle motor. When the nozzle in use has been removed, a current value required for the nozzle should decrease and eventually become 0, so that whether the nozzle is removed may be determined using the same. That is, when the current value of the nozzle in use falls to a value to be equal to or lower than a minimum current value required for nozzle driving, it may be determined that the nozzle has been removed.

The voltage controlled in the fixed pulse width modulation (PWM) scheme refers to a voltage obtained by controlling a switching period, which is one set of on and off of the voltage, to be constant in the pulse width modulation (PWM) scheme, and controlling an on-time-ratio, that is, a duty ratio or a duty cycle to be constant. Therefore, in this case, a shape like a square wave is repeated at a certain period in the voltage signal.

Conversely, when the current value is maintained at 0 as the current does not flow after the nozzle is removed, and then the current flows again, whether the nozzle has been re-connected may be determined using the same.

In addition, the present disclosure is to provide a control method for sensing a nozzle based on a type of nozzle motor included in the nozzle that is removable from a vacuum cleaner. That is, in the case of applying the voltage controlled in the same fixed pulse width modulation (PWM) scheme or applying the constant voltage by changing a magnitude thereof to the nozzle motor, a fact that different starting current profile characteristics are shown based on the number of rotations of a motor disposed in the nozzle, a speed reduction ratio of a gear assembly (or a power transmitter), and whether an auxiliary controller disposed inside the nozzle exists may be used. This is because values of a motor, a resistor, an inductor, and a capacitance are all different for the nozzles. Therefore, the present disclosure is to provide a control method that distinguishes the type of nozzle by analyzing the measured starting current profile.

The voltage controlled in the fixed pulse width modulation (PWM) scheme refers to the voltage obtained by controlling the switching period, which is one set of on and off of the voltage, to be constant in the pulse width modulation (PWM) scheme, and controlling the on-time-ratio, that is, the duty ratio or the duty cycle to be constant. Therefore, in this case, the shape like the square wave is repeated at the certain period in the voltage signal.

In addition, a method for accurately measuring the starting current must be accompanied when is to distinguish the type of nozzle through starting current profile analysis, so that the starting current may be measured by applying an ADC conversion scheme synchronized to voltage application time point and period based on a pulse width modulation duty ratio (PWM duty ratio).

Specifically, provided is a method for controlling a vacuum cleaner, wherein the vacuum cleaner includes a suctioning portion, a fan motor for generating a suction force for sucking air along the suctioning portion, a first nozzle including a first nozzle body connected to or removed from the suctioning portion, and a first nozzle driver accommodated in the first nozzle body for providing power to remove dusts, a second nozzle including a second nozzle body connected to or removed from the suctioning portion, and a second nozzle driver accommodated in the second nozzle body for providing power to remove dusts, and a measuring device for measuring a current value based on a control signal applied to the first nozzle or the second nozzle, wherein one of the first nozzle and the second nozzle is connected to the suctioning portion in an exchangeable manner from each other, wherein the method includes a removal sensing operation of measuring the current value in one of the first nozzle and the second nozzle being driven in connection with the suctioning portion, and sensing, based on the current value, whether said one nozzle has been removed from the suctioning portion, and a re-connection sensing operation of sensing whether one of the first nozzle and the second nozzle has been re-connected to the suctioning portion after said one nozzle has been removed therefrom.

In this connection, the removal sensing operation may include comparing the current value with a preset first allowable value, and sensing whether said one nozzle has been removed from the suctioning portion within a preset removal sensing duration from a first measurement time when the current value starts to decrease to a value to be equal to or lower than the first allowable value.

The re-connection sensing operation may include comparing a current value measured after said one of the first nozzle and the second nozzle is re-connected to the suctioning portion with a preset second allowable value, and when the measured current value exceeds the second allowable value at least once, proceeding to a first delay operation of interrupting the control signal for a preset first delay time.

The control signal may be a voltage controlled in a pulse width modulation (PWM) scheme having a preset voltage, a preset duty ratio, and a preset switching frequency, the measured current value may be a value converted through analog to digital conversion (ADC) after being sampled with a preset sampling period, the first allowable value and the second allowable value may also be values converted through the analog to digital conversion (ADC), the sampling period in the removal sensing operation, the operation maintaining operation, and the first delay operation may be a preset first sampling period, the sampling period in the re-connection sensing operation may be a preset second sampling period, and the second sampling period may be shorter than the first sampling period.

In addition, the method may further include a control signal re-applying operation of re-applying the control signal after the first delay time has elapsed, and starting to measure the current value with the first sampling period, and a nozzle distinguishing operation of sensing which nozzle among the first nozzle and the second nozzle is said one nozzle connected to the suctioning portion, and selecting an operation scheme of the fan motor or the connected nozzle based on the sensing result.

The nozzle distinguishing operation may include a nozzle sensing operation of sensing which nozzle among the first nozzle and the second nozzle is said one nozzle connected to the suctioning portion, and a nozzle operation selecting operation of selecting an operation scheme of the fan motor or the connected nozzle based on the nozzle sensed in the nozzle sensing operation.

The nozzle sensing operation may include sensing the first nozzle or the second nozzle, based on a difference between revolutions per minute of the first nozzle driver and revolutions per minute of the second nozzle driver, whether said one of the first nozzle and the second nozzle includes an auxiliary controller, or a difference between current values of the first nozzle and the second nozzle when speed reduction ratios of power transmitters respectively included in the first nozzle driver and the second nozzle driver are set to be different from each other.

When the revolutions per minute of the first nozzle driver and the revolutions per minute of the second nozzle driver are set to be different from each other, the nozzle sensing operation may include sensing a nozzle including a nozzle driver having a smaller revolutions per minute among the first nozzle and the second nozzle when the current value measured in said one nozzle mounted on the suctioning portion among the first nozzle and the second nozzle is equal to or lower than a preset first reference value.

In this connection, the first reference value may be a first threshold value preset for a preset first sensing duration.

In addition, the nozzle operation selecting operation may include maintaining rotation of the fan motor as it is when the nozzle sensed in the nozzle sensing operation is the nozzle including the nozzle driver having the smaller revolutions per minute.

When the revolutions per minute of the first nozzle driver and the revolutions per minute of the second nozzle driver are set to be different from each other, the re-connection sensing operation may include determining that one of the first nozzle and the second nozzle including the nozzle driver having the smaller revolutions per minute is sensed when the measured current value is higher than 0 and equal to or lower than the second allowable value, and proceeding to the operation maintaining operation of continuously applying the control signal.

When said one of the first nozzle and the second nozzle further includes the auxiliary controller, the nozzle sensing operation may include sensing the nozzle including the auxiliary controller when the current value measured in said one nozzle mounted on the suctioning portion among the first nozzle and the second nozzle is equal to or lower than a preset second reference value.

In this connection, the second reference value may be a second threshold value preset for a preset second sensing duration.

In addition, the nozzle operation selecting operation may include stopping rotation of the fan motor when the nozzle sensed in the nozzle sensing operation is the nozzle including the auxiliary controller.

In one example, when the first nozzle driver and the second nozzle driver have the same revolutions per minute, but have the different speed reduction ratios of the power transmitters respectively included therein, the nozzle sensing operation may include sensing a nozzle including a power transmitter with a lower speed reduction ratio when the current value measured in said one nozzle mounted on the suctioning portion among the first nozzle and the second nozzle is equal to or higher than a preset third reference value.

In this connection, the third reference value may be a third threshold value preset for a preset third sensing duration.

In one example, provided is a method for controlling a vacuum cleaner, wherein the vacuum cleaner includes a suctioning portion, a fan motor for generating a suction force for sucking air along the suctioning portion, a nozzle including a nozzle body connected to or removed from the suctioning portion, and a nozzle driver accommodated in the nozzle body for providing power to remove dusts, and a measuring device for measuring a current value based on a control signal applied to the nozzle, wherein the nozzle is connected to or removed from the suctioning portion, wherein the method includes a removal sensing operation of sensing whether the nozzle has been removed from the suctioning portion, based on the current value, and a re-connection sensing operation of sensing whether the nozzle has been re-connected to the suctioning portion after the nozzle has been removed from the suctioning portion.

Advantageous Effects

Effects of the present disclosure obtained through the above solutions are as follows. First, it is possible to provide a control method that senses whether a nozzle is removed and whether the nozzle is replaced and mounted. Second, it is possible to provide a control method that automatically senses a type of mounted nozzle. Third, it is possible to provide a control method that adjusts driving of a nozzle to be suitable for each nozzle through automatic sensing of a type of nozzle. Fourth, it is possible to provide a control method that may sense a type of nozzle without provision of separate sense means. Fifth, various user convenience functions may be provided through nozzle sensing.

DESCRIPTION OF DRAWINGS

FIG. 1A shows one embodiment of a handy-type or stick-type vacuum cleaner.

FIG. 1B shows one embodiment of a canister-type vacuum cleaner.

FIG. 2 is an exploded view of a handy-type vacuum cleaner.

FIG. 3A shows one embodiment of a nozzle.

FIG. 3B is an exploded view of one embodiment of a nozzle.

FIG. 3C is an exploded view of one embodiment of a nozzle driver.

FIG. 4A shows another embodiment of a nozzle.

FIG. 4B shows another embodiment of a nozzle.

FIG. 5 shows a starting current profile as an ADC value obtained by performing ADC conversion on a current value measured based on application of a voltage controlled in the same pulse width modulation (PWM) scheme.

FIG. 6 is a flowchart on nozzle sensing using a starting current profile.

FIG. 7A shows application of a PWM voltage including a first delay operation.

FIG. 7B shows a current profile obtained by measuring a current value based on an applied PWM voltage and converting the current value by ADC.

FIG. 8 is a flowchart on sensing of removal and re-connection of a nozzle.

FIG. 9 is a flowchart of a nozzle sensing operation and a nozzle operation selecting operation in a nozzle distinguishing operation.

FIG. 10 is a flowchart for preventing instantaneous restarting.

BEST MODE

Hereinafter, a preferred embodiment of the present disclosure will be described in detail with reference to the accompanying drawings. In one example, a configuration of a device or a method for controlling the same to be described below is only for describing an embodiment of the present disclosure, not for limiting the scope of the present disclosure, and reference numerals used the same throughout the specification refer to the same components.

Specific terms used in this specification are only for convenience of description and are not used as a limitation of the illustrated embodiment. For example, expressions indicating a relative or absolute arrangement such as "in a certain direction", "along a certain direction", "parallel", "orthogonal", "central", "concentric", "coaxial", or the like not only strictly indicate such arrangement, but also indicate a state in which a relative displacement is achieved with a tolerance, or an angle or a distance that achieves the same function.

For example, expressions indicating that things are in the same state, such as "same", "equal", "homogeneous", and the like, not only indicate strictly the same state, but also indicate a state in which a tolerance or a difference in a degree to which the same function is obtained exists.

For example, expressions indicating a shape such as a square shape, a cylindrical shape, or the like not only indicate a shape such as a square shape, a cylindrical shape, or the like in a geometrically strict sense, but also indicate a shape including an uneven portion, a chamfer, and the like in a range in which the same effect is obtained.

In one example, expressions such as "prepare", "equip", "have", "include", or "carry" one component are not exclusive expressions excluding existence of another component.

In addition, in this specification, the same and similar reference numerals will be given to the same and similar components even in different embodiments, and duplicated descriptions thereof will be omitted.

As long as there is no structural or functional contradiction between different embodiments, a structure applied to one embodiment may be equally applied to the other embodiment.

The singular expression includes the plural expression unless the context clearly dictates otherwise.

In describing the embodiment disclosed herein, when it is determined that a detailed description of a related known technology may obscure the gist of the embodiment disclosed herein, a detailed description thereof will be omitted.

The accompanying drawings are only for easy understanding of the embodiment disclosed herein, and the technical idea disclosed herein is not limited by the accompanying drawings. In addition, it should be understood that the technical idea disclosed herein includes all changes, equivalents, or substitutes included in the spirit and scope of the present disclosure.

FIG. 1 is a perspective view of a vacuum cleaner 1000 and 2000 of various types to which one embodiment of the present disclosure is applied. (a) in FIG. 1 is one embodiment of a handy-type or stick-type vacuum cleaner 1000, and (b) in FIG. 1 is one embodiment of a canister-type vacuum cleaner 2000. Referring to FIG. 1, the vacuum cleaner 1000 and 2000 according to one embodiment of the present disclosure may include a vacuum cleaner main body 10*a* and 10*b* having a fan motor (not shown) for generating a suction force, and a nozzle 100*a* and 100*b* that sucks air containing dusts. Both vacuum cleaners may receive power in a wired manner or a wireless manner using a battery.

A control method, which is one embodiment of the present disclosure, may be applied to another type of vacuum cleaner not shown in FIG. 1 when the nozzle is detachable from the vacuum cleaner and the vacuum cleaner has an electric driving device such as a separate motor. For example, the control method is also applicable to an upright-type vacuum cleaner in which the nozzle is rotatably connected to the main body.

The handy-type or stick-type vacuum cleaner 1000 shown in (a) in FIG. 1 may include an extension pipe 15*a* that connects the vacuum cleaner main body 10*a* and the nozzle 100*a* to each other. The extension pipe 15*a* is disposed on the vacuum cleaner main body 10*a* and is connected to a suctioning portion 101*a* that sucks dusts using a suction force generated by a fan motor 630 see FIG. 2). Although not shown in (a) in FIG. 1, the nozzle 100*a* in the handy-type or stick-type vacuum cleaner 1000 may be directly connected to the vacuum cleaner main body 10*a* without the extension pipe 15*a*.

In this specification, the dusts may be understood as a concept encompassing everything such as foreign substances attached to a surface-to-be-cleaned, for example, hair, lint, fine powder, plastic pieces, small insect corpses, and the like. Therefore, the dusts may include everything from invisible fine dusts to visible dusts with a certain weight. Therefore, the dusts may indicate everything that, when the surface-to-be-cleaned is pressed by rotation of a rotary cleaning portion, which will be described later, may be separated from the corresponding surface-to-be-cleaned and may be sucked in by the suction force of the fan motor.

The vacuum cleaner main body 10*a* may have a handle 540*a* for a user to grip. The user may perform cleaning while gripping the handle 540*a*. The vacuum cleaner main body 10*a* may have the battery (not shown), and the vacuum cleaner main body 10*a* may have a battery accommodating portion 500*a* in which the battery (not shown) is accommodated. The battery accommodating portion 500*a* may be provided below the handle 540*a*. The battery (not shown) may be connected to the nozzle 100*a* to supply power to the nozzle 100*a*.

A manipulation unit 570*a* may be located above the handle 540*a*, so that the user may manipulate an operation of the vacuum cleaner during use or turn on or off the vacuum cleaner. In particular, a locking-type switch that turns on the vacuum cleaner to be usable when pressed once, and turns off the vacuum cleaner when pressed once again other than a gun-type switch that should be pressed continuously to operate the vacuum cleaner may be disposed.

A controller (not shown) for controlling the fan motor 630 (see FIG. 2) and controlling a nozzle driver 140 (see (c) in FIG. 3) included in the nozzle 100*a* may be included inside the vacuum cleaner main body 10*a*. The controller (not shown) may apply a control signal for controlling a nozzle motor 143 included in the nozzle driver 140, and may include a measuring device (not shown) that measures a current flowing through the nozzle accordingly. The control signal may be a voltage having a fixed switching frequency, a PWM duty ratio, and a constant average voltage by being controlled in a pulse width modulation (PWM) scheme to control the nozzle motor 143.

In addition, the measuring device (not shown) may convert the measured current value by analog to digital conversion (ADC) rather than measuring the current flowing through the nozzle in an analog scheme. This will be described later with reference to FIG. 5.

The canister-type vacuum cleaner 2000 shown in (b) in FIG. 1 may further include a corrugated pipe 300 that connects the extension pipe 15*b* and the vacuum cleaner main body 10*b* to each other. The extension pipe 15*b* may connect the nozzle 200*b* and the corrugated pipe 300 to each other, and may be connected to a suctioning portion 101*b* that sucks dusts using a suction force generated by a fan motor (not shown).

A handle 540*b* for gripping the extension pipe 15*b* may be disposed at a portion of the extension pipe 15*b* meeting the corrugated pipe 300. The user may perform cleaning while gripping the handle 540*b*. The vacuum cleaner main body 10*b* may have a battery (not shown), or receive power in a wired manner from an external power source through a power cord. The received power may also be supplied to the nozzle 100*b* as the vacuum cleaner main body 10*b* is connected thereto.

A manipulation unit 570*b* may be located at a top of the handle 540*b*, so that the user may manipulate an operation of the vacuum cleaner during use or turn on or off the vacuum cleaner. In particular, the locking-type switch that turns on the vacuum cleaner to be usable when pressed once, and turns off the vacuum cleaner when pressed once again other than the gun-type switch that should be pressed continuously to operate the vacuum cleaner may be disposed. In contrast, a switch that supplies power to the vacuum cleaner may be located in the vacuum cleaner main body 10*b*.

In addition, the vacuum cleaner main body 10*a* and 10*b* may include a dusts container 400*a* and 400*b* in which the dusts separated from the air is stored. Accordingly, the dusts introduced through the nozzle 10*a* and 10*b* may be stored in the dusts container 400*a* and 400*b* through the extension pipe 15*a* and 15*b*.

FIG. 2 is an exploded view of the fan motor 630, a filter assembly 700, and the like according to one embodiment of the vacuum cleaner main body 10*a* in the handy-type or stick-type vacuum cleaner 1000. It may be seen that other types of vacuum cleaners also have the same basic configuration except that an appearance of the vacuum cleaner main body 10*b* is different.

The vacuum cleaner main body 10*a* may further include the fan motor 630 that generates the suction force for sucking the air and the filter assembly 700 that filters the air. The filter assembly 700 may include a pre filter 722 that filters the air before the air is sucked into the fan motor 630 past the suctioning portion 101*a*, a HEPA filter 726 that filters the air that has passed through the fan motor 630 past the pre filter 722, and a filter cover 724 that covers the HEPA filter 726.

The HEPA filter 726 may be disposed in an accommodating space (not shown) defined between partition walls formed beneath the discharge cover 650. When the HEPA filter is accommodated in the accommodating space (not shown), the filter cover 724 may cover the accommodating space.

While the HEPA filter 726 is accommodated in the accommodating space (not shown), the accommodating space is covered by the filter cover 724. The filter cover 724 may have at least one opening defined therein through which the air passes. In addition, the filter cover 724 may be detachably coupled to the discharge cover 650. Accordingly, the air that has passed through the pre filter 722 may pass through the fan motor 630, then pass through the HEPA filter 726, and then finally be discharged to the outside through the discharge cover 650. The vacuum cleaner main body 10*a* may include the fan motor 630, the suctioning portion 101*a* that sucks the air by a rotational force of the fan motor, a motor housing 600*a* including the fan motor 630 and the filter assembly 700, the dusts container 400*a*, the handle 540*a*, and the battery accommodating portion 500*a*.

The nozzle 100*a* connected to the suctioning portion 101*a* will be described with reference to FIGS. 3 and 4.

Referring to (a) and (b) in FIG. 3, the nozzle 100*a* may be directly connected to the suctioning portion 101*a*, may be connected to the suctioning portion 101*a* through the extension pipe 15*a* (see FIG. 1). That is, a shape of a portion where the extension pipe 15*a* and the suctioning portion 101*a* are coupled to each other may be the same as a shape of a portion where the nozzle 100*a* and the extension pipe 15*a* are coupled to each other or a shape of a portion where the nozzle 100*a* and the suctioning portion 101*a* are coupled to each other.

Accordingly, the nozzle 100*a* may be directly connected to the suctioning portion 101*a* or indirectly connected to the suctioning portion 101*a* through the extension pipe 15*a*.

Referring to (a) and (b) in FIG. 3, the nozzle 101*a* may include a nozzle body 110 that forms an appearance of the nozzle 101*a* and is connected to the suctioning portion 101*a*, a rotary cleaning portion 130 that is accommodated in the nozzle body 110, sucks the air by the rotation, and delivers the sucked air to the suctioning portion, and the nozzle driver 140 for rotating the rotary cleaning portion.

The nozzle body 110 may include a main body 111 that accommodates the rotary cleaning portion 130 and the nozzle driver 140 therein, and a connecting pipe 120. The main body 111 may have a front opening 111*a* defined therein for sucking the air containing contaminants.

Referring to a dotted arrow indicating an air flow in (a) in FIG. 3, the air may be introduced through the front opening 111*a* by the suction force generated by the fan motor 630 of the vacuum cleaner main body 10*a*. The introduced air may flow to the connecting pipe 120 through the rotary cleaning portion 130.

The front opening 111*a* may be defined to extend in a left and right direction of the nozzle body 110, and may be defined to extend not only to a bottom surface of the nozzle body 110 but also to a front surface of the nozzle body 110. Accordingly, because a suction area may be sufficiently secured, it is possible to clean the surface-to-be-cleaned area even at a point adjacent to a floor or wall surface.

The nozzle body 110 may further include the nozzle driver 140 that provides power for rotating the rotary cleaning portion 130. The nozzle driver 140 may be inserted into the rotary cleaning portion 130 at one side to transmit the power to the rotary cleaning portion 130. However, this is only an embodiment of transmitting the power. The nozzle driver 140 may not be inserted into the rotary cleaning portion 130 at one side, but may be located in a separate space oriented in a direction of the connecting pipe 120 and positioned in parallel with the rotary cleaning portion 130.

The main body 111 may cover at least a portion of an upper portion of the rotary cleaning portion 130. In addition, an inner circumferential surface of the main body 111 may be formed in a curved shape to correspond to a shape of an outer circumferential surface of the rotary cleaning portion 130. Accordingly, the main body 111 may perform a function of preventing the foreign substances brushed off from the cleaning-target-surface as the rotary cleaning portion 130 rotates from rising.

The nozzle body 110 may further include side surface covers 115 and 116 that respectively cover both side surfaces of the main body 111. The side surface covers 115 and 116 may be respectively disposed on both side surfaces of the rotary cleaning portion 130.

The side surface covers 115 and 116 include a first side surface cover 115 disposed on one side of the rotary cleaning portion 130 and a second side surface cover 116 disposed on the other side of the rotary cleaning portion 130. The nozzle driver 140 may be fixed to the first side surface cover 115.

The nozzle 100*a* further includes a rotation support 150 disposed on the second side surface cover 116 to rotatably support the rotary cleaning portion 130. The rotary support 150 may be inserted into the rotary cleaning portion 130 at the other side to rotatably support the rotary cleaning portion 130.

The connecting pipe 120 included in the nozzle body 110 may have a detachment button 122 for manipulating mechanical coupling with the extension pipe 15*a* (see FIG. 1) or the suctioning portion 101*a*. The user may couple or separate the nozzle 100*a* and the extension pipe 15*a* (see FIG. 1) to or from each other or couple or separate the nozzle 100*a* and the suctioning portion 101*a* to or from each other by manipulating the detachment button 122. The nozzle 100*a* may further include an auxiliary hose 123 that connects the connecting pipe 120 and the main body 111 to each other. Accordingly, the air sucked into the main body 111 may flow to the vacuum cleaner main body 10*a* through the auxiliary hose 123, the connecting pipe 120, and the extension pipe 15*a* (see FIG. 1).

The auxiliary hose 123 may be made of a flexible material to enable pivoting of the connecting pipe 120. A hinge hole 114 may be defined in the main body 111 at a portion to which the connecting pipe 120 is connected, and a hinge shaft 124 to be inserted into the hinge hole 114 may be disposed on the connecting pipe 120. Therefore, the connecting pipe 120 may be pivotably connected to the main body 111.

(c) in FIG. 3 shows one embodiment of the nozzle driver 140. The connection of the rotary cleaning portion 130 and the nozzle driver 140 may be achieved in various forms, but (c) in FIG. 3 shows one embodiment in which a portion of the nozzle driver 140 is inserted into the rotary cleaning portion 130 at one side. In this case, there is an advantage that a separate space for installing the nozzle driver 140 is not required.

The nozzle driver 140 includes the nozzle motor 143 and a nozzle motor support 141 for generating a driving force. The nozzle motor 143 may be equipped as a BLDC motor or a DC motor.

A PCB installation portion (not shown) on which a printed circuit board (PCB) for controlling the nozzle motor 143 is installed may be disposed at one side of the nozzle motor 143. Although not shown, the PCB may be embedded in or attached to the PCB installation portion. Therefore, when a voltage signal controlled in the PWM scheme applied from the controller (not shown) installed in the main body is received, a starting current profile representing an aspect of a starting current may vary based on the nozzle motor 143 and a resistor, an inductor, and a capacitor included in the PCB. That is, this is because a time constant value varies based on a resistance, an inductance, and a capacitance. Therefore, the starting current profile changes based on revolutions per minute of the nozzle motor, a speed reduction ratio of a power transmitter 145, and whether an auxiliary controller 135 (see (b) in FIG. 4) of the nozzle 100*a* is installed. This will be described in detail in FIG. 5.

The nozzle motor 143 may be coupled to the nozzle motor support 141 by a fastening member such as a bolt or the like. The nozzle motor 143 may have a fastening hole defined therein for bolt-fastening with the nozzle motor support 141.

The nozzle driver 140 may further include the power transmitter 145 for transmitting the power of the nozzle motor 143. (c) in FIG. 4 shows that the power transmitter 145 is equipped as a gear as an embodiment, but the power transmitter 145 may be of any structure capable of transmitting the power. For example, the nozzle driver 140 may not be inserted into the rotary cleaning portion 130 at one side and may be disposed in parallel with the rotary cleaning portion in the separate space oriented in the direction of the connecting pipe 120. In this case, the power transmitter 145 may be equipped as a pulley and a belt connecting the same, unlike in (c) in FIG. 4.

The nozzle motor 143 is coupled to the power transmitter 145. The power transmitter 145 may have a hollow defined therein into which the nozzle motor 143 is inserted. The power transmitter 145 may be coupled to the nozzle motor support 141 using a bolt, and a fastening hole may be defined at one side of the power transmitter 145 for this purpose.

The power transmitter 145 transmits rotational power generated from the nozzle motor 143 to the rotary cleaning portion 130 by appropriately reducing the revolutions per minute of the nozzle motor using a gear ratio or a difference in a radius of the pulley. That is, a speed reduction ratio of the nozzle motor 143 is determined based on a ratio of gears equipped in the power transmitter 145, and the revolutions per minute of the rotary cleaning portion 130 is determined accordingly. This is to deliver optimized revolutions per minute and rotational torques optimized based on the cleaning-target-surface.

For example, in a case of a fluffy nozzle for general use and a carpet nozzle for carpet cleaning, the same type of nozzle motor of the same size is used. However, a speed reduction ratio of the carpet nozzle is lower than a speed reduction ratio of the fluffy nozzle, so that the revolutions per minute of the rotary cleaning portion of the carpet nozzle may be large. This means that a current required for driving is large.

Unless otherwise stated in this specification, the revolutions per minute of the nozzle driver 140 means revolutions per minute of the nozzle motor 143 before passing through the power transmitter 145, and doesn't mean revolutions per minute reduced based on the speed reduction ratio after passing through the power transmitter 145. In addition, the speed reduction ratio of the nozzle motor 143 means a ratio of speed reduction by the gear or the pulley equipped in the power transmitter 145. In this specification, the speed reduction ratio of the power transmitter or the speed reduction ratio of the nozzle motor have the same meaning.

The nozzle driver 140 may further include a cover member 147 that surrounds the power transmitter 145. The cover member 147 has a function of protecting the power transmitter 145. The nozzle driver 140 may further include a shaft (not shown) connected to the power transmitter 145, and a shaft 148 may be connected to the rotary cleaning portion 130.

The rotary cleaning portion 130 may brush off the contaminants by being rotated by a driving force transmitted through the nozzle driver 140 and rubbing against the cleaning-target-surface. In addition, the outer circumferential surface of the rotary cleaning portion 130 may be made of a fabric such as wool or a felt material. Accordingly, the foreign substances such as the dusts and the like accumulated on the cleaning-target-surface may be effectively removed by being caught in the outer circumferential surface of the rotary cleaning portion 130 during the rotation of the rotary cleaning portion 130. The nozzle 100*a* in the case in which the speed reduction ratio of the power transmitter 145 is different has been described in FIG. 3. The power transmitter 145 that transmits the driving force between the nozzle motor 143 of the nozzle driver 140 and the rotary cleaning portion 130 is disposed. In addition, the power transmitter 145 has a structure such as a pair of gears that are engaged with each other, thereby reducing the revolutions per minute of the nozzle motor 143 by the speed reduction ratio and transmitting the reduced revolutions per minute to the rotary cleaning portion 130.

FIG. 4 relates to a nozzle 100*c* and 100*d* having a different shape or function. (a) in FIG. 4 shows a nozzle 100*c* in a form of being inverted such that a portion thereof in contact with the surface-to-be-cleaned faces forward in order to show characteristics of the rotary cleaning portion 130*c*. (b) in FIG. 4 also shows a nozzle 100*d* in a form in which a top surface of a main body 111*d* is removed in order to show a rotary cleaning portion 130*d*, a nozzle driver 140*d*, and the auxiliary controller 135.

Like the nozzle 100*a* in FIG. 3, the nozzle 100*c* and 100*d* has a nozzle body 110*c* and 110*d* having a main body 111*c* and 111*d* and a connecting pipe 120*c* and 120*d*, a rotary cleaning portion 130*c* and 130*d*, and a nozzle driver 140*c* and 140*d* that transmits a rotational driving force to the rotary cleaning portion 130*c* and 130*d*.

However, the nozzle 100*c* in (a) in FIG. 4 may include a spike-shaped protrusion 131 protruding along an outer circumferential surface of the rotary cleaning portion 130*c*. In addition, the nozzle driver 140*c* is inserted into the rotary cleaning portion 130*c*. In addition, revolutions per minute of the nozzle driver 140*c* may be the same as or similar to revolutions per minute of the rotary cleaning portion 130*c* because the speed reduction ratio is 0 or low.

This is because a reaction force that the rotary cleaning portion 130 receives through pressurization of the cleaning-target-surface is small as the dusts may be well dropped by tapping the cleaning-target-surface through the protrusion 131, and the revolutions per minute of the nozzle driver 140*c* does not have to be high. Therefore, an initial current value of a current starting profile is very small because a relatively small amount of current is required for driving compared to other nozzles. Therefore, the nozzle 100*c* with the small revolutions per minute may be distinguished. In one example, the protrusion 131 has a knocking effect, so that the nozzle 100*c* with the small revolutions per minute may be used for cleaning bedding.

The nozzle 100*d* in (b) in FIG. 4 includes a plurality of rotary cleaning portions 130*d* and a plurality of nozzle drivers 140*d* for rotating the plurality of rotary cleaning portions 130*d*, respectively. In addition, the nozzle 100*d* may further include a water supply (not shown) for supplying water to a rotary pad (not shown) attached to a bottom surface of the plurality of rotary cleaning portions 130*d* for water cleaning. Therefore, the nozzle 100*d* may be used as a wet mop nozzle. For control of the water supply and control of the plurality of nozzle drivers 140*d*, the nozzle 100*d* may include the auxiliary controller 135. The auxiliary controller 135 may be positioned anywhere inside the nozzle body 110*d* as long as the auxiliary controller 135 is able to control the water supply and the plurality of nozzle drivers 140*d*. The auxiliary controller 135 may include a control component such as a micom (micro-process based controller or micro-computer), and a large-capacity capacitor may be required to activate the micom. Therefore, a time to charge such a large-capacity capacitor is required at the beginning of the driving. After all, because the starting current profile shows a characteristic pattern in which the current value approaches almost 0 at a specific time, the nozzle 100*d* may be distinguished from other nozzles therethrough.

The nozzle 100*c* that may be used for the bedding because the revolutions per minute is small and the reaction force received from the cleaning-target-surface is small, the nozzle 100*d* that may be used as the wet mop by including the auxiliary controller and the water supply, and the nozzle 100*a* including the power transmitter 145 that allows the nozzle motor 143 having the great revolutions per minute to have an appropriate speed reduction ratio have been described with reference to FIGS. 3 and 4.

The nozzles 100*a*, 100*c*, and 100*d* have different characteristics, so that the nozzles 100*a*, 100*c*, and 100*d* may be used for different purposes. For example, the nozzle 100*a* including the power transmitter 145 that allows the nozzle motor 143 having the great revolutions per minute to have the appropriate speed reduction ratio may allow the nozzle motor 143 to have a relatively low speed reduction ratio, for example, 3.3:1, so that the nozzle 100*a* may be used as the carpet nozzle. In addition, when the nozzle 100*a* allows the nozzle motor 143 to have a relatively high speed reduction ratio, for example, 13.5:1, the nozzle 100*a* may be used as the fluffy nozzle for the general purpose. The nozzle 100*c* with the small revolutions per minute of the nozzle motor and the small reaction force received from the cleaning-target-surface may be used as the bedding nozzle. The nozzle 100*d* including the auxiliary controller and the water supply may be used as the wet mop nozzle.

The difference in the revolutions per minute of the nozzle drivers, whether the auxiliary controllers exist, and the difference in the speed reduction ratio of the power transmitters allow two or more different types of nozzles to be distinguished from each other. For example, when the nozzle motors are all the DC motors, it is not easy to distinguish the nozzles from each other. However, each nozzle may be distinguished through the starting current profile.

The starting current profile indicates a graph of a current value (or a value converted by the ADC) over time showing a change in the current value that appears at the beginning of driving based on the nozzle motor equipped in the nozzle, the PCB, and the auxiliary controller with respect to the voltage controlled in the pulse width modulation scheme applied to the nozzle or the constant voltage whose magnitude is varied. That is, the starting current profile shows an aspect of the change in the current over time within a preset nozzle sensing time when the voltage controlled by the pulse width modulation is applied to the nozzle through the controller as the vacuum cleaner is turned on.

The starting current profile shows a different aspect based on the difference in the revolutions per minute of the nozzle motors, the difference in the speed reduction ratio of the nozzle motors or the power transmitters, and whether the auxiliary controllers exist. Using this, even when the same type of nozzle motor is used, nozzles for different purposes may be distinguished.

The control signal applied to the nozzle may be the voltage controlled in the pulse width modulation (PWM) scheme or the constant voltage of the varied magnitude. Herein, the voltage controlled in the pulse width modulation (PWM) scheme will be described.

One set of on and off of the voltage is referred to as a switching period. In the pulse width modulation (PWM) scheme, the voltage may be controlled by allowing the switching period to be constant and adjusting an on-time-ratio, that is, a duty ratio or a duty cycle. In the present disclosure, the duty ratio or a switching frequency (the number of switching periods per second) is made constant, and the magnitude of the voltage is kept constant. This is referred to as the voltage controlled in the fixed pulse width modulation (PWM) scheme or a PWM voltage. By applying such PWM voltage, it is possible to obtain a starting current profile based on such PWM voltage.

A current transducer such as an oscilloscope may be required to measure the starting current profile of the nozzle based on the PWM voltage application. However, in the present disclosure, it is possible to measure a voltage across a shunt resistor connected in series to the nozzle, without adding such costly component, and then convert the measured voltage to a current value by Ohm's law. As a result, the current value that appears when the nozzle starts to drive may be measured. The current value is measured on the measuring device. The measuring device may be included in the controller or may be disposed separately.

In addition, the measurement of the corresponding current value may be performed through the analog to digital conversion (ADC) that converts an analog signal into a digital signal. This may be done using an ADC converter included in the controller. Therefore, the starting current profile that appears initially at the beginning of the nozzle driving may be measured with a constant sampling time interval (or a sampling period), for example, a time interval or period of 10 ms, and converted by the ADC. This is referred to as ADC sampling. Therefore, the corresponding current value may be converted to have a value converted to the ADC rather than in ampere units, that is, to have one value in a range equal to or greater than 0 bit and equal to or smaller than 255 bits.

Therefore, when no current flows, that is, in a case of 0 amps, the current value may be converted to 0 bits. In addition, when the current flows with a maximum allowable value (unit: amps), the current value may be converted to 255 bits.

In addition, when there is no mention of the sampling period in this specification, the control method of the present disclosure may perform the ADC sampling with a first sampling period without performing a re-connection sensing operation (S410) to be described later, and may perform the sampling rapidly with a second sampling period shorter than the first sampling period in the re-connection sensing operation (S410) in order to sense re-connection of the nozzle to the suctioning portion 101*a*. For example, when the first sampling period is 10 ms, the second sampling period may be 1 ms.

FIG. 5 is an embodiment of the starting current profile showing the ADC-converted value (unit: bit) of the current value compared to the sampling time (unit: ms) from the time of driving after mounting the nozzle of the vacuum cleaner using the scheme as above.

However, in order to obtain a clear profile with little deviation as shown in FIG. 5, a time point at which the PWM voltage is applied and an ADC measurement time point should be synchronized. This is because distinguishment from a starting current profile of another nozzle is not easy as a deviation of an ADC sampling interval is added when the PWM voltage application time point and the ADC measurement time point are not synchronized. As a dispersion of the measurement point occurs, a sensing power for sensing the nozzle decreases, so that the synchronization is required to prevent this.

That is, the synchronization refers to performing the ADC sampling at certain time point and period after applying the PWM voltage by a preset duty cycle. For example, when the current value is obtained through the ADC sampling of 10 times after applying the PWM voltage based on the duty cycle of the PWM, the synchronization refers to performing the ADC sampling at the certain time point and period such as 1 ms, 11 ms, and 21 ms.

In addition, the magnitude of the applied voltage must also be considered as the distinguishment may be more easy with a low voltage than with a high voltage. For example, a pulse width modulation duty ratio may be 760 at 23 V, which is a minimum voltage operatable by the vacuum cleaner battery system. However, this is only one embodiment, and may vary depending on specifications and circumstances of the nozzle motor used.

Hereinafter, the bedding nozzle, the wet mop nozzle, the carpet nozzle, and the fluffy nozzle, which are four types that may be distinguished based on the revolutions per minute of the same DC type motor or the nozzle driver 140, the difference in the speed reduction ratio of the nozzle motors 143 or the power transmitters 145, and whether the auxiliary controllers 135 exist will be described using FIG. 5.

FIG. 5 schematically shows the starting current profile that varies based on the revolutions per minute of the nozzle motor 143 or the nozzle driver 140, the difference in the speed reduction ratio of the power transmitters 145, and whether the auxiliary controllers 135 exist.

As described above, the printed circuit board (PCB) for the control may be installed on one side of the nozzle motor 143 equipped in the nozzle driver 140. Therefore, when the PWM-controlled voltage signal applied from the controller (not shown) installed on the main body is received, the starting current profile indicating the aspect of the starting current may vary based on the nozzle motor, and the resistor, the inductor, and the capacitor included in the PCB. That is, this is because the time constant value varies based on the resistance, the inductance, and the capacitance. Therefore, this means that the starting current profile changes based on the difference in the revolutions per minute of the nozzle motors, the difference in the speed reduction ratio of the power transmitters 145, and whether the auxiliary controllers 135 of the nozzles are installed.

When the vacuum cleaner is turned on after the nozzle is mounted on the suctioning portion 101*a* of the main body 10*a*, the controller drives the fan motor 630 and applies the voltage controlled to have a fixed PWM to the nozzle. Accordingly, the current value in the nozzle is measured at a constant sampling interval through the ADC sampling. Preferably, the current value may be measured at an interval of 10 ms.

In the case of the bedding nozzle, the revolutions per minute may be small because the reaction force received during the rotation of the rotary cleaning portion 130*c* is small when the rotary cleaning portion 130*c* performs the rotational movement. In addition, a driving current value resulted therefrom is small. Accordingly, the current profile may be measured to be equal to or lower than a preset first reference value. The term "equal to or lower than the preset first reference value" refers to a case in which the current value (or the value converted by the ADC) measured during a preset first sensing duration is equal to or lower than a preset first threshold value CP1. When the first threshold value is a value having the bit unit obtained by converting the measured current value by the ADC, it means that the current value has the same unit corresponding thereto. This also applies to a second threshold value and a third threshold value below. That is, in the case of comparison with the measured current value, unless otherwise stated, values having the same unit are compared with each other.

The preset first sensing duration means a time interval between a 1-1 sensing time (td1-1) and a 1-2 sensing time (td1-2) at the beginning of the driving of the nozzle driver 140*c*. In the starting current profile of the bedding nozzle, during the first sensing duration, sensing is possible in a first sensing region, which is a range equal to or lower than the first threshold value. Therefore, the control method of the present disclosure may use this to distinguish whether the nozzle currently mounted on the suctioning portion 101*a* is the bedding nozzle.

In the case of the nozzle other than the bedding nozzle, the revolutions per minute of the nozzle driver may be relatively large. Therefore, because the nozzle requires a lot of initial current, the nozzle has a current value exceeding the first threshold value during the first sensing duration. In the end, it is possible to distinguish between the bedding nozzle and the nozzle other than the bedding nozzle.

In particular, it may be seen that the carpet nozzle and the wet mop nozzle with the nozzle driver rotating at a high speed require a relatively large amount of current during the first sensing duration.

In the case of the wet mop nozzle, the auxiliary controller 135 is required to control a pump (not shown) for the water supply and the plurality of nozzle drivers 140. The auxiliary controller generally includes the control component called the micom (micro-process based controller or micro-computer). The large-capacity capacitor may be required to activate the micom at the beginning of the driving. Therefore, the time to charge such a large-capacity capacitor is required at the beginning of the driving. This results in the characteristic pattern in which the current value approaches almost 0 at the specific time in the starting current profile. Using this, the wet mop nozzle 100*d* may be distinguished from other nozzles.

Referring to FIG. 5, when the measured current value is measured to be equal to or lower than a preset second reference value, the nozzle may be determined to be the wet mop nozzle, which is the nozzle including the auxiliary controller. The term "equal to or lower than the preset second reference value" refers to a case in which the current value (or the value converted by the ADC) measured during a preset second sensing duration is equal to or lower than a preset second threshold value CP2.

The preset second sensing duration means a time interval between a 2-1 sensing time (td2-1) and a 2-2 sensing time (td2-2) at the beginning of the driving of the nozzle driver 140*c*. During such duration, while the large-capacity capacitor is being charged to activate the auxiliary controller, the current value approaches almost zero. Therefore, when a range equal to or lower than the second threshold value during the second sensing duration is set as a second sensing region, the wet mop nozzle including the auxiliary controller may be distinguished. The remaining nozzles may have current values exceeding the second threshold value during the second sensing duration.

When the charging of the large-capacity capacitor is finished, the auxiliary controller 135 is activated and the required current increases again, so that the current profile is excessively increased again. After reaching a normal state, the current profile descends and converges to a constant current value based on the supplied voltage.

When the revolutions per minute of the nozzle motor 143 is relatively great, a lot of current is initially required as in the carpet nozzle and the fluffy nozzle in FIG. 5. Thereafter, the measured current profile gradually descends. At this time, a difference in a decrease amount of the current profile between both nozzles occurs. This is because there is a difference in the speed reduction ratio even when the revolutions per minute of the nozzle drivers 140 or revolutions per minute of the nozzle motors 143 are the same. Therefore, in the case of the carpet nozzle with a low speed reduction ratio, a large amount of current is required at the beginning of the driving because of the highest driving speed of the rotary cleaning portion. Therefore, a current value relatively high compared to other nozzles is maintained during the nozzle sensing time.

When the measured current value is measured to be equal to or higher than a preset third reference value, it may be seen that the nozzle is the carpet nozzle that has the nozzle driver 140 including the nozzle motor 143 with the great revolutions per minute, and has the power transmitter 145 with the low speed reduction ratio. In this connection, the term "equal to or higher than the preset third reference value" refers to a case in which the current value (or the value converted by the ADC) measured during a preset third sensing duration is equal to or higher than a preset third threshold value CP3. In the opposite case, that is, when the current value measured during the third sensing duration is lower than the third threshold value, the nozzle may be determined to be the fluffy nozzle with a high speed reduction ratio.

Finally, using the third sensing region, it is possible to distinguish between the fluffy nozzle and the carpet nozzle.

Because the bedding nozzle, the wet mop nozzle, the carpet nozzle, and the fluffy nozzle are only distinguished based on the purposes thereof, nozzles are not limited to the nozzles used for such purposes. That is, the bedding nozzle and other nozzles may be distinguished based on the nozzle driver with the smallest revolutions per minute, and the wet mop nozzle and other nozzles may be distinguished based on whether the auxiliary controller 135 is included. In addition, the carpet nozzle and the fluffy nozzle may be distinguished based on the different speed reduction ratios thereof.

Therefore, in FIG. 5, the four types of nozzles may be distinguished using the starting current profiles that vary depending on the revolutions per minute of the nozzle drivers 140, the difference in the speed reduction ratio of the nozzle motors or the power transmitters 145, and whether the auxiliary controllers 135 exist. Therefore, the present disclosure is not necessarily limited to the bedding nozzle, the wet mop nozzle, the carpet nozzle, and the fluffy nozzle named based on the cleaning-target-surface, and this is only one embodiment that changes based on the revolutions per minute of the nozzle drivers 140, the difference in the speed reduction ratio of the nozzle motors or the power transmitters 145, and whether the auxiliary controllers 135 exist. Therefore, hereinafter, the nozzles are named as a first nozzle, a second nozzle, a third nozzle, and a fourth nozzle, and then, distinguished based on the revolutions per minute of the nozzle drivers 140, the difference in the speed reduction ratio of the nozzle motors or the power transmitters 145, and whether the auxiliary controllers 135 exist.

In addition, distinguishing the four types of different nozzles means that distinguishment is possible even when only two of the four types of nozzles are used. For example, in a case in which the first nozzle has the smallest revolutions per minute of the nozzle driver 140 and consumes the least current, the second nozzle includes the auxiliary controller, and the third nozzle and the fourth nozzle have the same great revolutions per minute, but the third nozzle has the speed reduction ratio lower than the speed reduction ratio of the fourth nozzle, when distinguishment is possible for 6 cases, which is combinations of 2 of 4 types, distinguishment is possible for 3 cases, which is combinations of 3 of 4 types.

For example, the distinguishment may be possible for a total of six cases, that is, between the first nozzle and the second nozzle, between the first nozzle and the third nozzle, between the first nozzle and the fourth nozzle, between the second nozzle and the third nozzle, between the second nozzle and the fourth nozzle, and between the third nozzle and the fourth nozzle.

Therefore, the first nozzle and the second nozzle may be distinguished using the fact that one has the current value equal to lower than the first reference value and the other one has the current value equal to or lower than the second reference value. The first nozzle and the third nozzle may be distinguished using the fact that one has the current value equal to lower than the first reference value and the other one has the current value lower than the third reference value. The first nozzle and the fourth nozzle may be distinguished using the fact that one has the current value equal to lower than the first reference value and the other one has the current value equal to or higher than the third reference value. The second nozzle and the third nozzle may be distinguished using the fact that one has the current value equal to lower than the second reference value and the other one has the current value lower than the third reference value. The second nozzle and the fourth nozzle may be distinguished using the fact that one has the current value equal to lower than the second reference value and the other one has the current value equal to or higher than the third reference value. Finally, the third nozzle and the fourth nozzle may be distinguished using the third reference value.

In FIGS. 6 to 10, description is achieved using the bedding nozzle, the wet mop nozzle, the carpet nozzle, or the fluffy nozzle, but this is only one embodiment. Therefore, the present disclosure is not necessarily limited to the bedding nozzle, the wet mop nozzle, the carpet nozzle, and the fluffy nozzle named based on the cleaning-target-surface, and this is only one embodiment using the fact that the nozzles are distinguished based on the revolutions per minute of the nozzle drivers 140, the difference in the speed reduction ratio of the nozzle motors or the power transmitters 145, and whether the auxiliary controllers 135 exist. Therefore, it may also be described that the nozzles are named as the first nozzle, the second nozzle, the third nozzle, and the fourth nozzle, and then, distinguished based on the revolutions per minute of the nozzle drivers 140, the difference in the speed reduction ratio of the nozzle motors or the power transmitters 145, and whether the auxiliary controllers 135 exist.

FIG. 6 is to describe a control method for sensing a type of nozzle within a preset nozzle sensing time using a characteristic of a starting current profile that appears at the beginning of the driving of each nozzle after the nozzle is connected to the suctioning portion 101*a* and the vacuum cleaner is turned on.

The vacuum cleaner may include the suctioning portion, the fan motor that generates the suction force for sucking the air along the suctioning portion, and the measuring device that the current value of the nozzle based on the voltage signal controlled in the pulse width modulation (PWM) scheme applied to one of the first nozzle, the second nozzle, the third nozzle, and the fourth nozzle, which are four types of nozzles that may be mounted on the suctioning portion in an exchangeable manner at the certain sampling interval using the ADC conversion.

The first nozzle may be the bedding nozzle with the smallest revolutions per minute of the nozzle driver and the relatively small amount of the driving current. The second nozzle may be the wet mop nozzle including the auxiliary controller, and the third nozzle and the fourth nozzle may be the carpet nozzle (with the low speed reduction ratio) and the fluffy nozzle (with the high speed reduction ratio), respectively, having the same revolutions per minute, but having the different speed reduction ratios of the power transmitters 145. However, the user may not recognize which nozzle the first nozzle to the fourth nozzle are.

In this connection, when the user mounts one nozzle and then turn the vacuum cleaner on, the control method of the present disclosure operates the fan motor, and applies the PWM voltage to one nozzle connected to the suctioning portion among the first nozzle to the fourth nozzle. Accordingly, the measuring device performs a fan motor starting operation (S100) of starting the ADC sampling of the current value in the nozzle.

Thereafter, the control method of the present disclosure proceeds to a nozzle sensing operation (S200) of measuring the current value (the value converted by the ADC) based on the PWM voltage applied within the preset nozzle sensing time, for example, 100 ms, and sensing or distinguishing which nozzle the nozzle connected to the suctioning portion is.

The nozzle sensing operation (S200) may sense what the currently mounted nozzle is through the comparison of the measured current value with the first reference value, the second reference value, and the third reference value described in FIG. 5. When the measured current value is equal to or lower than the first reference value (equal to or lower than the first threshold value during the first sensing duration) (S210), the control method of the present disclosure may sense (S211) the currently mounted nozzle as the first nozzle (or the bedding nozzle) having the smallest revolutions per minute of the nozzle driver 140 and the smallest amount of current used.

When the measured current value is equal to or lower than the second reference value (equal to or lower than the second threshold value during the second sensing duration) (S230), the control method of the present disclosure may sense (S231) the currently mounted nozzle as the second nozzle (or the wet mop nozzle) including the auxiliary controller 350 of the nozzle driver 140.

When the measured current value is equal to or higher than the third reference value (equal to or higher than the third threshold value during the third sensing duration) (S250), the control method of the present disclosure may sense (S251) the currently mounted nozzle as the third nozzle (or the carpet nozzle) having the relatively great revolutions per minute compared to other nozzles, but having the low speed reduction ratio.

When the measured current value is lower than the third reference value (lower than the third threshold value during the third sensing duration), the control method of the present disclosure may sense (S253) the currently mounted nozzle as the fourth nozzle (or the fluffy nozzle) with the high speed reduction ratio, unlike the carpet nozzle.

On the other hand, the control method of the present disclosure may first sense the fourth nozzle by determining whether the measured current value is lower than the third reference value, and then, determine the third nozzle by determining whether the measured current value is equal to or higher than the third reference value. In addition, after obtaining the starting current profile within the nozzle sensing time, the type of nozzle may be distinguished.

In addition, unlike using the first reference value, the second reference value, or the third reference value as described above, it is possible to distinguish the type of nozzle using another scheme. That is, the above-described nozzle type sensing or nozzle distinguishing method uses the three reference values as the thresholds in the three sensing regions, respectively. Alternatively, the nozzle may be distinguished in a statistical and stochastic scheme through current data acquired at every ADC sampling period, for example, every 10 ms. For example, when the number of times the carpet nozzle was sensed and the number of times the fluffy nozzle was sensed through the data acquired at every sampling period during the nozzle sensing time are 5 times and 2 times, respectively, it's highly probable that the nozzle may be the carpet nozzle, so that it may be determined that the carpet nozzle was sensed.

The control method of the present disclosure proceeds to a nozzle operation selecting operation (S300) of selecting an appropriate operation when the nozzle is sensed in the nozzle sensing operation (S200).

When the first nozzle (or the bedding nozzle) is sensed (S211), the control method of the present disclosure may maintain (S310) the current operation without stopping the fan motor 630. This is because a rated current of the first nozzle is not large and it is possible to not change a state of the fan motor through floor sensing.

When the second nozzle (or the wet mop nozzle) is sensed (S231), the control method of the present disclosure may stop (S330) the operation of the fan motor 630. This is to prevent water used for the cleaning from being sucked in by the suction force of the fan motor 630. However, whether to operate the fan motor 630 may be selected by selecting ON/OFF of the fan motor 630 in response to selection of the user.

When the third nozzle (or the wet mop nozzle) is sensed (S251), the control method of the present disclosure may adjust the revolutions per minute of the fan motor 630 through cleaning-target-surface sensing (S350). The adjustment of the revolutions per minute of the fan motor 630 means that the suction force of the fan motor 630 may be adjusted. This is because, for example, different suction forces may be required depending on a difference between the carpet and a wooden floor. However, this may vary depending on a use mode of the vacuum cleaner. When the user selects a manual mode as the use mode of the vacuum cleaner, the floor may not be automatically sensed.

When the fourth nozzle (or the fluffy nozzle) is sensed (S253), the control method of the present disclosure may adjust the revolutions per minute of the fan motor 630 through the cleaning-target-surface sensing (S370). The adjustment of the revolutions per minute of the fan motor 630 means that the suction force of the fan motor 630 may be adjusted. This is because, for example, the different suction forces may be required depending on the difference between the carpet and the wooden floor. However, this may vary depending on the use mode of the vacuum cleaner. When the user selects the manual mode as the use mode of the vacuum cleaner, the floor may not be automatically sensed.

So far, the control method for sensing the type of nozzle using the characteristic of the starting current profile that appears at the beginning of the driving of each nozzle after the nozzle is connected to the suctioning portion 101*a* and the vacuum cleaner is turned on has been described.

Contrary to this, FIGS. 7 and 8 are to describe a control method of sensing (S400) removal of the nozzle and a control method of sensing (S410) connection of the nozzle respectively for a case in which the nozzle has been removed while being used by being connected to the suctioning portion 101*a* and a case in which the nozzle is connected again when the vacuum cleaner is continuously in the On state.

As described above, the manipulation unit 570*a* is located above the handle 540*a*, so that the user may manipulate the operation of the vacuum cleaner during use or turn on or off the vacuum cleaner. In particular, the switch that turns on the vacuum cleaner to be usable when pressed once, and turns off the vacuum cleaner when pressed once again other than the gun-type switch that should be pressed continuously to operate the vacuum cleaner may be disposed.

Therefore, the user may use the vacuum cleaner by disconnecting the nozzle in use while the vacuum cleaner is in the On state, and then connecting the vacuum cleaner to another nozzle. Alternatively, the vacuum cleaner may be used by disconnecting the nozzle in use, and then connecting the same nozzle again. In this connection, the user may exchange only the nozzle while the fan motor 630 disposed in the main body 10*a* of the vacuum cleaner continues to operate.

In other words, only the exchange of the nozzle may be made while the PWM voltage is continuously applied. Because a change also occurs in the current profile of the nozzle at this time, it is possible to sense the removal and the connection of the nozzle using the change. Even in this case, the measuring device may perform the ADC sampling with the first sampling period.

(a) in FIG. 7 shows application of the PWM voltage. As described above, the PWM voltage may be applied with the constant PWM duty ratio. (a) in FIG. 7 shows that the PWM voltage is a continuous impulse, but this is only a schematical indication due to a scale of time. Strictly, the PWM voltage may be in a form of a square wave having a constant PWM duty ratio.

(b) in FIG. 7 shows an embodiment of a current profile of when the nozzle is disconnected and connected while the vacuum cleaner is in the On state, and the starting current profile of the nozzle described in FIG. 6 after a preset first delay time.

It may be seen that the current value, which was kept constant, gradually decreases and eventually becomes 0 in an initial current profile in (b) in FIG. 7. This means that the nozzle being used has been removed from the vacuum cleaner main body 10*a*. Even when the nozzle is suddenly disconnected during use, the current value does not immediately drop to 0, but gradually decreases without directly dropping to 0 because of influence of circuit components, that is, the inductor, the capacitor, and the like.

Therefore, in the removal sensing operation (S400) in FIG. 8, the control method of the present disclosure may wait (S401) for the removal of the nozzle while continuously applying the PWM voltage while the vacuum cleaner is operating and performing the ADC sampling (S401) of the current value with the first sampling period. When the current value is continuously equal to or lower than a first allowable value for a preset removal sensing duration (Tdet) from a first measurement time (tm1), which is a time point from which the current value is measured to be equal to or lower than the preset first allowable value, the control method of the present disclosure may sense (S403) the removal of the nozzle by finally determining the removal (or the separation) of the nozzle at a time of disconnection (Ts), which is a time point at which the removal sensing duration has elapsed. The removal sensing duration may be preferably set to 100 ms. In addition, the first allowable value may be a maximum current value at which the control method of the present disclosure starts to sense the removal of the nozzle.

In general, when the nozzle has been removed, the current value may converge to 0 before the time of disconnection (Ts). Therefore, after the time of disconnection (Ts), the current value is maintained at 0. However, because the vacuum cleaner is still in the On state, the PWM voltage may be continuously applied even after the time of disconnection (Ts) as shown in (a) in FIG. 7. When the user disconnects the nozzle during use and then reconnects the nozzle—which may be the removed same nozzle, or may be a different type of nozzle, the current value may increase momentarily due to the applied PWM voltage. (b) in FIG. 7 shows sudden rise of the current appearing when the user re-connects (or connects) the nozzle at a second measurement time (tm2).

Therefore, in the re-connection sensing operation (S200, FIG. 8) that is performed after the time of disconnection (Ts), the control method of the present disclosure may wait (S411) to sense the sudden rise occurring from the second measurement time. When the measured current value exceeds a preset second allowable value even once (S413), the PWM voltage application is stopped (S430). Therefore, the current value that has risen sharply returns to 0 again. A time point at which the current value becomes 0 is referred to as a third measurement time. In (b) in FIG. 7, a time interval from the second measurement time to the third measurement time may be referred to as a time of impulse (Timp). The time of impulse may generally be 2 to 3 ms.

In order to measure such short time of impulse (S411), the measuring device should perform the ADC sampling with a sampling period shorter than a general sampling period. That is, the measuring device may perform high-speed sampling. For example, when the general sampling period is 10 ms, a sampling period in the high-speed sampling may be 1 ms. Therefore, the control method of the present disclosure may use (S411) the second sampling period shorter than the first sampling period, which is the general sampling period, for the high-speed sampling only in the re-connection sensing operation (S410).

Therefore, the control method of the present disclosure may proceed (S411) to the ADC sampling with the second sampling period for the high-speed sampling until sensing the connection of the nozzle after the removal of the nozzle in the re-connection sensing operation (S410). In other words, from the time of disconnection (Ts) to the third measurement time, the high-speed ADC sampling may be performed for sensing the nozzle connection. In addition, it is possible to prevent extension of an instantaneous driving time of the nozzle motor due to a delay in the ADC conversion.

This may improve an ability to sense the connection of the nozzle, reduce a sensing time, prevent instantaneous driving of the nozzle motor 143, and prevent an emotional defect that the user may feel during the instantaneous driving.

When the current value rising within the time of impulse (Timp) is higher than 0 and lower than the second allowable value, the control method of the present disclosure proceeds to an operation maintaining operation (S420) of continuously maintaining the application of the PWM voltage without interruption. This means that the type of re-connected nozzle does not require much initial driving current. That is, because it means that the revolutions per minute of the nozzle motor 143 or the revolutions per minute of the nozzle driver 140 is relatively small, the control method of the present disclosure may determine the re-connected nozzle as the bedding nozzle.

When sensing the bedding nozzle, because it is no longer necessary to distinguish the nozzle, the control method of the present disclosure may continuously apply the PWM voltage during the preset first delay time without stopping the application of PWM voltage. Then, the ADC sampling may be performed again with the first sampling period. That is, after the third measurement time, the control method of the present disclosure may continue to maintain the application of the PWM voltage, and may perform the sampling of the current value with the first sampling period in preparation for the removal of the nozzle in the future.

The control method of the present disclosure may not perform sensing (S631, see FIG. 9) of the bedding nozzle again by comparing (S611, see FIG. 9) the current value with the preset first reference value in a nozzle distinguishing operation (S600) to be described later. This is because the control method of the present disclosure has already determined that the connected nozzle is the bedding nozzle in the operation maintaining operation (S420) through the re-connection sensing operation (S410). Therefore, the control method of the present disclosure may proceed directly to a nozzle operation selecting operation (S650), and continuously operate the fan motor without stopping (S651).

When the current value rising within the time of impulse (Timp) exceeds the second allowable value even once, the control method of the present disclosure may determine that a nozzle of a different type other than the bedding nozzle is connected. In this case, in order to determine the type of connected nozzle, the control method of the present disclosure proceeds to a first delay operation (S430) of stopping the application of the PWM voltage for the preset first delay time. Preferably the first delay time may be set to 1.2 seconds. The reason that the first delay time is required is to discharge all charged electric energy when there is a separate charging circuit, for example, the capacitor, for the motor driving. Without the discharge, the measuring device may measure an incorrect current value, which eventually causes the controller to sense the wrong nozzle type. As a result, all of the electric energy charged may be discharged during the first delay time to improve a sensing performance.

The control method of the present disclosure proceeds to a control signal re-applying operation (S500) of applying the PWM voltage again from a time when the first delay time has elapsed, that is, a fourth measurement time. In addition, the measuring device proceeds with the ADC sampling with the first sampling period. Thereafter, the control method of the present disclosure executes the nozzle distinguishing operation (S600) of distinguishing the type of nozzle within a preset nozzle sensing time (Tfind) using the starting current profile as described in FIG. 5.

FIG. 9 shows the nozzle distinguishing operation (S600) in detail. This is similar to the nozzle sensing operation (S200) and the nozzle operation selecting operation (S300) described above.

After the first delay operation (S430) and the control signal re-applying operation (S500), the control method of the present disclosure proceeds to a nozzle sensing operation (S610) of measuring the current value (the value converted by the ADC) based on the PWM voltage applied within the preset nozzle sensing time, for example, 100 ms, and sensing or distinguishing which nozzle the nozzle connected to the suctioning portion 101*a* is.

The nozzle sensing operation (S610) may sense what the currently mounted nozzle is by comparing the measured current value thereof with the first reference value, the second reference value, and the third reference value described in FIG. 5. When the measured current value is equal to or lower than the first reference value (equal to or lower than the first threshold value during the first sensing duration) (S611), the control method of the present disclosure may sense (S631) the currently mounted nozzle as the first nozzle (or the bedding nozzle) having the smallest revolutions per minute of the nozzle driver 140 and the smallest amount of current used.

However, because the bedding nozzle is already able to be sensed in the operation maintaining operation (S420) in FIG. 8, there is no need for the control method of the present disclosure to sense (S631) the nozzle as the bedding nozzle by determining whether the current value is equal to or lower than the first reference value (S611) in the nozzle sensing operation (S610) again.

As described above, when the current value rising within the time of impulse (Timp) is higher than 0 and equal to or lower than the second allowable value in the re-connection sensing operation (S410), the control method of the present disclosure may determine that the re-connected nozzle does not require much initial driving current. That is, this indicates the case in which the revolutions per minute of the nozzle motor 143 or the revolutions per minute of the nozzle driver 140 is the smallest, so that the control method of the present disclosure may directly determine that the re-connected nozzle is the bedding nozzle.

Therefore, in this case, the control method of the present disclosure may not perform the sensing of the bedding nozzle (S631) by comparing (S611) the current value with the preset first reference value in the nozzle distinguishing operation (S600) to be described later again. As a result, the control method of the present disclosure may proceed directly to the nozzle operation selecting operation (S650) and may continuously operate the fan motor without stopping (S651).

Alternatively, the control method of the present disclosure may sense the bedding nozzle in the nozzle sensing operation (S610) in FIG. 9 instead of proceeding to the operation maintaining operation (S420) in FIG. 8.

When the measured current value is equal to or lower than the second reference value (equal to or lower than the second threshold value during the second sensing duration) (S613), the control method of the present disclosure may sense (S633) the currently mounted nozzle as the second nozzle (or the wet mop nozzle) including the auxiliary controller 350 of the nozzle driver 140.

When the measured current value is equal to or higher than the third reference value (equal to or higher than the third threshold value during the third sensing duration) (S615), the control method of the present disclosure may sense (S635) the currently mounted nozzle as the third nozzle (or the carpet nozzle) having the relatively great revolutions per minute compared to other nozzles, but having the low speed reduction ratio.

When the measured current value is lower than the third reference value (lower than the third threshold value during the third sensing duration), the control method of the present disclosure may sense (S637) the currently mounted nozzle as the fourth nozzle (or the fluffy nozzle) with the high speed reduction ratio, unlike the carpet nozzle.

On the other hand, the control method of the present disclosure may first sense the fourth nozzle by determining whether the measured current value is lower than the third reference value first, and then, determine the third nozzle by determining whether the measured current value is equal to or higher than the third reference value. In addition, after obtaining the starting current profile within the nozzle sensing time, the type of nozzle may be distinguished.

The control method of the present disclosure proceeds to the nozzle operation selecting operation (S650) of selecting the appropriate operation when the nozzle is sensed in the nozzle sensing operation (S610).

When the first nozzle (or the bedding nozzle) is sensed (S631), the control method of the present disclosure may maintain (S651) the current operation without stopping the fan motor 630. This is because the rated current of the first nozzle is not large and it is possible to not change the state of the fan motor through the floor sensing.

When the second nozzle (or the wet mop nozzle) is sensed (S633), the control method of the present disclosure may stop (S653) the operation of the fan motor 630. This is to prevent water used for the cleaning from being sucked in by the suction force of the fan motor 630. However, whether to operate the fan motor 630 may be selected by selecting ON/OFF of the fan motor 630 in response to the selection of the user.

When the third nozzle (or the wet mop nozzle) is sensed (S635), the control method of the present disclosure may adjust the revolutions per minute of the fan motor 630 through the cleaning-target-surface sensing (S655). The adjustment of the revolutions per minute of the fan motor 630 means that the suction force of the fan motor 630 may be adjusted. This is because, for example, the different suction forces may be required depending on the difference between the carpet and the wooden floor. However, this may vary depending on the use mode of the vacuum cleaner. When the user selects the manual mode as the use mode of the vacuum cleaner, the floor may not be automatically sensed.

When the fourth nozzle (or the fluffy nozzle) is sensed (S637), the control method of the present disclosure may adjust the revolutions per minute of the fan motor 630 through the cleaning-target-surface sensing (S657). The adjustment of the revolutions per minute of the fan motor 630 means that the suction force of the fan motor 630 may be adjusted. This is because, for example, the different suction forces may be required depending on the difference between the carpet and the wooden floor. However, this may vary depending on the use mode of the vacuum cleaner. When the user selects the manual mode as the use mode of the vacuum cleaner, the floor may not be automatically sensed.

The nozzle sensing operation (S200) and the nozzle operation selecting operation (S300) described above are applicable even in a case in which the nozzle is in used by being directly connected to the suctioning portion 101*a* or indirectly connected to the suctioning portion 101*a* through the extension pipe 15*a* or in a case in which the vacuum cleaner in operation is turned off and then turned on.

FIG. 10 relates to a control method for preventing (S715) instantaneous restarting of the nozzle by continuously checking (S710) whether the vacuum cleaner is turned off while being used by the user or while being in operation.

The control method of the present disclosure may continue to check (S710) whether the vacuum cleaner is turned off while being used by the user or while being in operation. In addition, the control method of the present disclosure may determine (S730) whether the vacuum cleaner is turned on again within a preset instantaneous power supply time after being turned off, or whether the vacuum cleaner is turned on again after the instantaneous power supply time. Preferably, the instantaneous power supply time may be set to 1 second. This is because it is physically impossible to exchange and mount the nozzle within 1 second.

When the vacuum cleaner is turned off and then is turned on after the instantaneous power supply time elapses, the control method of the present disclosure may delay the operation of the vacuum cleaner for a preset second delay time (S740) without directly operating the vacuum cleaner. Preferably, the second delay time may be set to 1 second.

The reason for stopping the operation of the vacuum cleaner during the second delay time is that it takes time until the driving current of the nozzle becomes almost 0 after the vacuum cleaner is turned off. That is, because the nozzle has the inductor and the capacitor, even when the vacuum cleaner is turned off, the driving current of the nozzle does not immediately fall to 0, but gradually decreases. Therefore, this is because a current that has not yet been reduced and a newly supplied current may exceed a current limit value at which the vacuum cleaner may be safely driven when the fan motor 630 is operated again without the second delay time and the nozzle 100*a* is operated. In order to prevent this, the control method of the present disclosure may delay the operation of the vacuum cleaner for the second delay time without immediately operating the vacuum cleaner when the vacuum cleaner is turned on after the instantaneous power supply time has elapsed.

After the second delay time elapses, the control method of the present disclosure operates the fan motor 630, applies the PWM voltage to the nozzle connected to the suctioning portion 101*a*, and then proceeds to a fan motor restarting operation (S760) of starting the ADC sampling.

When the vacuum cleaner is turned on after the instantaneous power supply time has elapsed, there is a possibility that the nozzle may be replaced and mounted in the meantime. Thus, the control method of the present disclosure again proceeds to a nozzle distinguishing operation (S780) of sensing what kind of nozzle the nozzle connected to the suctioning portion 101*a* is, and selecting an operation suitable for the type of nozzle. This is the same as the nozzle sensing operation (S200) and the nozzle operation selecting operation (S300) described above.

In this specification, a specific embodiment has been exemplified. It will be apparent to those skilled in the art in relation to the present disclosure that the specific embodiment shown may be replaced with any reconstruction calculated to achieve the same purpose and that the disclosed present disclosure may be applied differently in different environments. For example, in the case of using the BLDC motor rather than the DC motor to distinguish the type of nozzle, the type of nozzle may also be distinguished by differentially applying time constants of driver ICs of the BLDC motors. On the other hand, the type of nozzle may also be distinguished by obtaining a current starting profile by applying voltage across a resistor connected in parallel with a minus terminal of the connector that electrically connects the nozzle and the main body to each other and connected in series with a pull-up resistor, and measuring voltage divided on the two.

That is, the present application should be understood to cover any application or variation to the disclosure of the present disclosure. The claims are not limited the scope of the disclosure with respect to specific embodiments of this specification. Therefore, when the modified embodiment includes components of the claims of the present disclosure, it should be viewed as belonging to the scope of the present disclosure.

The invention claimed is:

1. A method for controlling a vacuum cleaner, the vacuum cleaner including a suctioning portion; a fan motor for generating a suction force for sucking air along the suctioning portion; a first nozzle including a first nozzle body connected to or removed from the suctioning portion, and a first nozzle driver accommodated in the first nozzle body for providing power to remove dusts; a second nozzle including a second nozzle body connected to or removed from the suctioning portion, and a second nozzle driver accommodated in the second nozzle body for providing power to remove dusts; and a measuring device for measuring a current value based on a control signal applied to the first nozzle or the second nozzle, wherein one of the first nozzle and the second nozzle is connected to the suctioning portion in an exchangeable manner from each other, the method comprises:

a removal sensing operation of measuring the current value in one of the first nozzle and the second nozzle being driven in connection with the suctioning portion, and sensing, based on the current value, whether said one of the first nozzle and the second nozzle has been removed from the suctioning portion; and a re-connection sensing operation of sensing whether one of the first nozzle and the second nozzle has been re-connected to the suctioning portion after said one of the first nozzle and the second nozzle has removed therefrom, wherein the removal sensing operation includes:

comparing the current value after being sampled during a preset first sampling period with a preset first allowable value; and sensing whether said one of the first nozzle and the second nozzle has been removed from the suctioning portion within a preset removal sensing duration from a first measurement time when the current value starts to decrease to a value to be equal to or lower than the first allowable value, and wherein the re-connection sensing operation includes:

comparing a current value measured after being sampled during a preset second sampling period shorter than the first sampling period, after said one of the first nozzle and the second nozzle is re-connected to the suctioning portion with a preset second allowable value;

determining that the measured current value is equal to or less than the second allowable value at least once, and in response to the determination that the measured current value is equal to or less than the second allowable value, proceeding to an operation maintaining operation of continuously applying the control signal and continuously operating the fan motor without stopping; and determining that the measured current value exceeds the second allowable value at least once, and in response to the determination that the measured current value exceeds the second allowable value:

stopping application of the control signal for a preset first delay time, and performing a control signal re-applying operation and a nozzle distinguishing operation, wherein the control signal re-applying operation includes re-applying the control signal after the first delay time has elapsed, and starting to measure the current value during the first sampling period, and wherein the nozzle distinguishing operation includes sensing which nozzle among the first and second nozzle is said one of the first nozzle and the second nozzle re-connected to the suctioning portion, and selecting and performing an operation of the fan motor or the connected nozzle based on the sensing result.

2. The method of claim 1, wherein the control signal is a voltage controlled in a pulse width modulation (PWM) scheme having a preset voltage, a preset duty ratio, and a preset switching frequency, wherein the measured current value is a value converted through analog to digital conversion (ADC), wherein the first allowable value and the second allowable value are also values converted through the analog to digital conversion (ADC).

3. The method of claim 1, wherein the nozzle distinguishing operation includes: a nozzle sensing operation of sensing which nozzle among the first nozzle and the second nozzle is said one of the first nozzle and the second nozzle re-connected to the suctioning portion; and a nozzle operation selecting operation of selecting an operation of the fan motor or the connected nozzle based on the nozzle sensed in the nozzle sensing operation.

4. The method of claim 3, wherein the nozzle sensing operation includes:

sensing the first nozzle or the second nozzle, based on a difference between revolutions per minute of the first nozzle driver and revolutions per minute of the second nozzle driver, whether said one of the first nozzle and the second nozzle re-connected to the suctioning portion includes an auxiliary controller, or a difference between current values of the first nozzle and the second nozzle when speed reduction ratios of power transmitters respectively included in the first nozzle driver and the second nozzle driver are set to be different from each other.

5. The method of claim 4, wherein, when the revolutions per minute of the first nozzle driver and the revolutions per minute of the second nozzle driver are set to be different from each other, the nozzle sensing operation includes:

sensing a nozzle including a nozzle driver having a smaller revolutions per minute among the first nozzle and the second nozzle when the current value measured in said one nozzle mounted on the suctioning portion among the first nozzle and the second nozzle is equal to or lower than a preset first reference value.

6. The method of claim 5, wherein the first reference value is a first threshold value preset for a preset first sensing duration.

7. The method of claim 6, wherein the nozzle operation selecting operation includes:

maintaining rotation of the fan motor as it is when the first or second nozzle sensed in the nozzle sensing operation is the first or second nozzle including the first or second nozzle driver having a smaller revolutions per minute.

8. The method of claim 4, wherein, when the revolutions per minute of the first nozzle driver and the revolutions per minute of the second nozzle driver are set to be different from each other, the re-connection sensing operation includes:

determining that one of the first nozzle and the second nozzle re-connected to the suctioning portion including the nozzle driver having the smaller revolutions per minute is sensed when the measured current value is higher than 0 and equal to or less than the second allowable value, and proceeding to the operation maintaining operation.

9. The method of claim 4, wherein, when said one of the first nozzle and the second nozzle re-connected to the suctioning portion further includes the auxiliary controller, the nozzle sensing operation includes:

sensing the nozzle including the auxiliary controller when the current value measured in said one of the first nozzle and the second nozzle mounted on the suctioning portion among the first nozzle and the second nozzle is equal to or less than a preset second reference value.

10. The method of claim 9, wherein the second reference value is a second threshold value preset for a preset second sensing duration.

11. The method of claim 10, wherein the nozzle operation selecting operation includes:

stopping rotation of the fan motor when the nozzle sensed in the nozzle sensing operation is the nozzle including the auxiliary controller.

12. The method of claim 4, wherein, when the first nozzle driver and the second nozzle driver have the same revolutions per minute, but have the different speed reduction ratios of the power transmitters respectively included therein, the nozzle sensing operation includes:

sensing a nozzle including a power transmitter with a lower speed reduction ratio when the current value measured in said one of the first nozzle and the second nozzle mounted on the suctioning portion among the first nozzle and the second nozzle re-connected to the suctioning portion is equal to or higher than a preset third reference value.

13. The method of claim 12, wherein the third reference value is a third threshold value preset for a preset third sensing duration.

* * * * *